US005912427A

United States Patent [19]

Willis et al.

[11] Patent Number: 5,912,427

[45] Date of Patent: Jun. 15, 1999

[54] SEMICONDUCTOR BRIDGE EXPLOSIVE DEVICE

[75] Inventors: Kenneth Ellsworth Willis, Redwood City; Martin Gerald Richman, Salinas; William David Fahey, Cupertino; John Gareth Richards; David S. Whang, both of San Jose, all of Calif.

[73] Assignee: Quantic Industries, Inc., San Carlos, Calif.

[21] Appl. No.: 08/381,170

[22] Filed: Jan. 31, 1995

Related U.S. Application Data

[63] Continuation-in-part of application No. 08/170,658, Dec. 20, 1993, abandoned, which is a continuation-in-part of application No. 08/023,075, Feb. 26, 1993, abandoned.

[51] Int. Cl.[6] ..... F42B 3/13

[52] U.S. Cl. ..... 102/202.8; 102/202.7; 102/202.9; 102/202.14; 361/248

[58] Field of Search ..... 102/202.7, 202.8, 102/202.9, 202.14, 202.5; 361/248, 249, 250, 251

[56] References Cited

U.S. PATENT DOCUMENTS

| | | | |
|---|---|---|---|
| 3,018,732 | 1/1962 | Tognola | 102/70.2 |
| 3,196,041 | 7/1965 | McNulty et al. | 102/202.8 |
| 3,269,315 | 8/1966 | Gauld et al. | 102/70.2 |
| 3,292,537 | 12/1966 | Goss, Jr. | 102/202.9 |
| 3,366,055 | 1/1968 | Hollander, Jr. | 102/202.7 |
| 3,763,782 | 10/1973 | Bendler et al. | 102/202.9 |
| 4,484,523 | 11/1984 | Smith et al. | 102/202.5 |
| 4,708,060 | 11/1987 | Bickes, Jr. et al. | 102/202.7 |
| 4,708,069 | 11/1987 | Kidd | 110/275 |
| 4,715,280 | 12/1987 | Wittwev | 102/202.8 |
| 4,729,315 | 3/1988 | Proffit et al. | 102/202.9 |
| 4,831,933 | 5/1989 | Nerheim et al. | 102/202.9 |
| 4,944,225 | 7/1990 | Barker | 102/202.5 |
| 4,976,200 | 12/1990 | Benson et al. | 102/202.7 |
| 5,029,529 | 7/1991 | Mandigo et al. | 102/202.9 |
| 5,080,016 | 1/1992 | Osher | 102/202.7 |
| 5,085,146 | 2/1992 | Baginski | 102/202.5 |
| 5,094,167 | 3/1992 | Hendley, Jr. | 102/218 |
| 5,230,287 | 7/1993 | Arrell et al. | 102/202.5 |
| 5,243,492 | 9/1993 | Marquit et al. | 361/247 |
| 5,592,022 | 1/1997 | Richards et al. | 257/735 |

FOREIGN PATENT DOCUMENTS

| | | | |
|---|---|---|---|
| 0112245 | 6/1984 | European Pat. Off. . | |
| 4317332 | 9/1992 | Japan . | |
| 5133699 | 5/1993 | Japan | 102/202.7 |
| 816530 | 7/1959 | United Kingdom | 102/202.8 |
| 94/19661 | 9/1994 | WIPO . | |

OTHER PUBLICATIONS

English translation of Japanese patent # 5,133,699.

Benson et al., Semiconductor Bridge: A Plasma Generator for the Ignition of Explosives, Journal of Applied Physics vol. 62, No. 5, Sep. 1, 1987, pp. 1622–1632.

*Primary Examiner*—Stephen M. Johnson

*Attorney, Agent, or Firm*—Wilson Sonsini Goodrich & Rosati; Robert Moll

[57] ABSTRACT

This invention discloses a method of fabricating an electro-explosive device which utilizes a semiconductor bridge as an ignition element. The semiconductor bridge is electrically connected to a metal header by a small, low resistance contact to the extension of bridge material and through an insulating silicon substrate to an eutectic bond created by gold plating on the metal header and the silicon. The second electrode of the bridge circuit is connected via wire bonds to one or two conducting pins which penetrate the metal header and are insulated by surrounding glass. A redundant connection via two conducting pins insulated from the header to one electrode of the semiconductor bridge allows a post assembly test of the integrity of the wire bonds, thereby increasing reliability of the device.

21 Claims, 20 Drawing Sheets

SEMICONDUCTOR BRIDGE EXPLOSIVE DEVICE

TECHNICAL FIELD

The present invention relates to a method for producing electroexplosive devices (EEDs) which utilize a semiconductor bridge (SCB) as the ignition element. The present application is a continuation-in-part application of U.S. application Ser. No. 08/170,658, filed on Dec. 20, 1993, now abandoned, which is a continuation-in-part of U.S. application Ser. No. 08/023,075, filed on Feb. 26, 1993, now abandoned. The present application claims priority to and incorporates by reference the entire disclosures of U.S. application Ser. Nos. 08/170,658 and 08/023,075.

BACKGROUND

Military weapons systems and automotive air bag systems are typically activated by an electroexplosive device. The EED usually employs a small metal bridgewire to ignite a contained explosive mixture. An electric current typically in the range of from about 1 amp to about 7 amps is passed through the bridgewire. Internal resistance heats the bridgewire to a temperature in excess of about 900° K. The hot bridgewire ignites an energetic powder, triggering the primer which in turn ignites the propellant or explosive in the system. The system may incorporate a pyrotechnic mixture, a propellant or an explosive powder.

A problem with the bridgewire type EED is a sensitivity to externally generated electric currents. High levels of electromagnetic energy from sources such as radio waves, static electricity, lightning or radar may induce an electric current within the bridgewire sufficient to cause an undesired, premature ignition.

The invention of the semiconductor bridge for electroexplosive devices was disclosed in U.S. Pat. No. 3,366,055 by Hollander, Jr. Several embodiments were described by Hollander which encompass all current materials used to fabricate SCBs. A semiconductor bridge circuit as described by Hollander, Jr. will initiate the explosive reaction within the primer when a current is applied. The SCB circuit is significantly less susceptible to induced electric currents and the resultant possibility of accidental or premature ignition is reduced.

A semiconductor bridge circuit comprises a circuit formed on a semiconductor material such as silicon. A heavily doped silicon region of an n-type dopant such as phosphorous is vaporized when a current of sufficient amperage is applied. The silicon vapor is electrically heated and permeates the adjacent energetic powder mixture. Through localized convection and condensation, the energetic powder is heated to its ignition temperature leading to the desired explosive reaction being initiated.

FIG. 1 shows in cross-sectional representation an EED 10 for a semiconductor bridge circuit 12 as known in the prior art. The housing 20 encases a semiconductor device 12 formed from a semiconductor material such as silicon. The SCB device includes a heavily doped bridge 13 which vaporizes when a threshold current is applied. The primer housing 20 positions the bridge 13 in close proximity to a charge 14 of an energetic powder such as lead azide The EED 10 comprises a pair of metallic feed through leads 16 which pass through a ceramic header 18. A conventional glass to metal seal bonds the feed through leads 16 to the header 18. A metallic casing 20 made, for example, of aluminum surrounds the ceramic header 18 and a charge holder 22. Wire bonds 24 electrically interconnect the metal feed through leads 16 to bond pads 26 formed on opposite sides of the surface of the semiconductor bridge device 12, with one bonding pad located on each side of the bridge and connecting to the lead wire on the surface of the die. When a voltage is applied across feed through leads 16, current flows through the bridge 13. The bridge vaporizes forming a plasma cloud within the energetic powder 14. The electric current further heats the plasma vapor such that local convection and condensation heat the energetic powder 14 to ignition. The entire process from application of voltage to ignition takes place in less than about 20 micro-seconds.

A problem with the primer housing 10 of the prior art are (1) the ceramic header 18 is brittle and subject to fracture when the explosive device is handled roughly, and (2) the wire bonds 24 are in contact with the primer charge 14. The primer charge is compacted to maximize the explosive energy. Another problem is that compaction of the powder 14 applies stresses to the wire bonds 24 potentially leading to the wires either breaking or pulling loose from either the feed through leads 16 or from the bond pads 26. This package is not a preferred structure. Forming ceramic headers with metal feed-throughs is a relatively expensive process adding to the cost of the device. This is particularly true if the casing 20 must be hermetically sealed against the ceramic 18. Further, if large electrical pads are used to achieve low resistance connections, it increases the die 12 area and therefore the size and cost of the device.

The advantages of the SCB type initiator over the bridgewire include lower electrical energy requirements, less susceptibility to accidental or premature initiation and more rapid and precise firing times. However, methods used to attach the semiconductor bridge die to the EED header have demonstrated poor reliability and have been costly to produce. The SCB circuit is formed on a brittle semiconductor substrate. The package housing the device must provide both mechanical and environmental protection to the device. The components making up the electronic package must also be compatible with the SCB device, the energetic powder, and the attachment materials. The electrical connections to the die must withstand pressure from powder loading and consolidation.

Several patents have focused on methods for attaching the SCB to a header in order to lower cost and improve reliability. One method for fabricating the SCB to achieve efficient attachment to a header is disclosed in U.S. Pat. No. 4,708,069 to Bickes, Jr., et al., and in Sandia National Labs Report No. SAND 86-2211 edited by Bickes, Jr., both of which are incorporated herein by reference. Bickes is distinguished from Hollander by using "a pair of spaced pads connected by a bridge, the area of each of said pads being much larger than the area of said bridge . . . " as shown in FIG. 2. These large pads 30 are used to achieve electrical contact with a metallized layer 34 covering the pads. The large pad size described in Bickes was used to achieve a low resistance connection to the polysilicon bridge material 32. This low resistance contact allowed a low impedance bridge, typically about 1 ohm which is common in the art, to be used which further reduced susceptibility to RF energy.

Subsequently, in U.S. Pat. No. 5,029,529, Mandigo discloses a method of attaching an SCB die in an electrical primer housing which eliminates one lead wire to the die (FIG. 3) which is an apparent improvement over Bickes, et al. An electrically conducting die attach means 72 is used to attach the SCB die 52 to a copper alloy primer button 40. The electrical pulse to fire the bridge follows a conductive path 74 through the silicon based device 52 and through a conductor or shunt 76 attached to the side of the die 52, The attachment method disclosed by Mandigo was used with an electrical primer 70 which is constructed from a cup 42 which forms one electrode for the external current source and a button 40 which forms the second electrode. This configuration requires an interposed insulator 54 and a conducting path from the cup 42 to the die 52 created by a wire 44 attached to the die and a conducting element 48 which is attached to the cup. This application requires a more complex assembly than conventional EEDs because it is used in gun ammunition; it is relevant to this disclosure only because of the method of achieving a conducting path through the silicon die 74 by doping the silicon. The attachment method of Mandigo suffers from three disadvantages. First, the shunt 76 must be attached on the side of the die after the die is cut from the wafer; this process is not easily performed with standard semiconductor processing technology. Second, a single wire 44 connects the bridge to the conducting case, which is subject to failure. Third, the method utilizes the large pads of Bickes, et al. with the attendant disadvantages discussed above.

SUMMARY OF THE INVENTION

Therefore, in accordance with the invention, there is provided an electronic package incorporating a semiconductor bridge type initiator circuit which does not have the disadvantages of a ceramic header type package or large connecting pads. It is an advantage of the present invention that the package components are manufactured from a standard TO (transistor outline) package widely used in the semiconductor industry and available at low cost. It is another advantage of the invention that in one embodiment of the invention the lead wires are configured to minimize the potential for breakage and subsequent device failure. By using two wires connected at one end to one bonding pad on the die and at the opposite wire ends to separate and redundant pins insulated from the header, the device can be tested before and after loading the explosive powder. This test is accomplished by checking for the presence of a very low resistance between the redundant insulated pins. Any imperfection in the bonds or wire will increase the measured resistance so as to detect the flaw. Yet another advantage of the invention is that small pads of electrical material can be used to connect the bridge, as opposed to the large pads of Bickes', thereby reducing the amount of silicon per die which in turn produces higher yields, lower cost per die, increased structural rigidity, and resistance to fracture during powder pressing. It is another advantage of the invention that automated assembly methods developed for the semiconductor industry can be used in assembly, thereby improving reliability and reducing cost. It is another advantage of the invention that a eutectic bond between the bridge die and the metal header dissipates heat effectively, thereby reducing vulnerability to spurious induced currents in the bridge. This bonding method also provides more mechanical strength to resist fracture from pressing the explosive powder onto the header.

In another embodiment, the present invention describes an improved method of mounting which includes a semiconductor bridge die (SCB die) mounted in a trench of the ceramic substrate. The SCB die is further secured from shifting under the load of an explosive powder by an adhesive in the trench.

The above figures are not to scale.

DESCRIPTION OF SPECIFIC EMBODIMENTS

Figure 1:
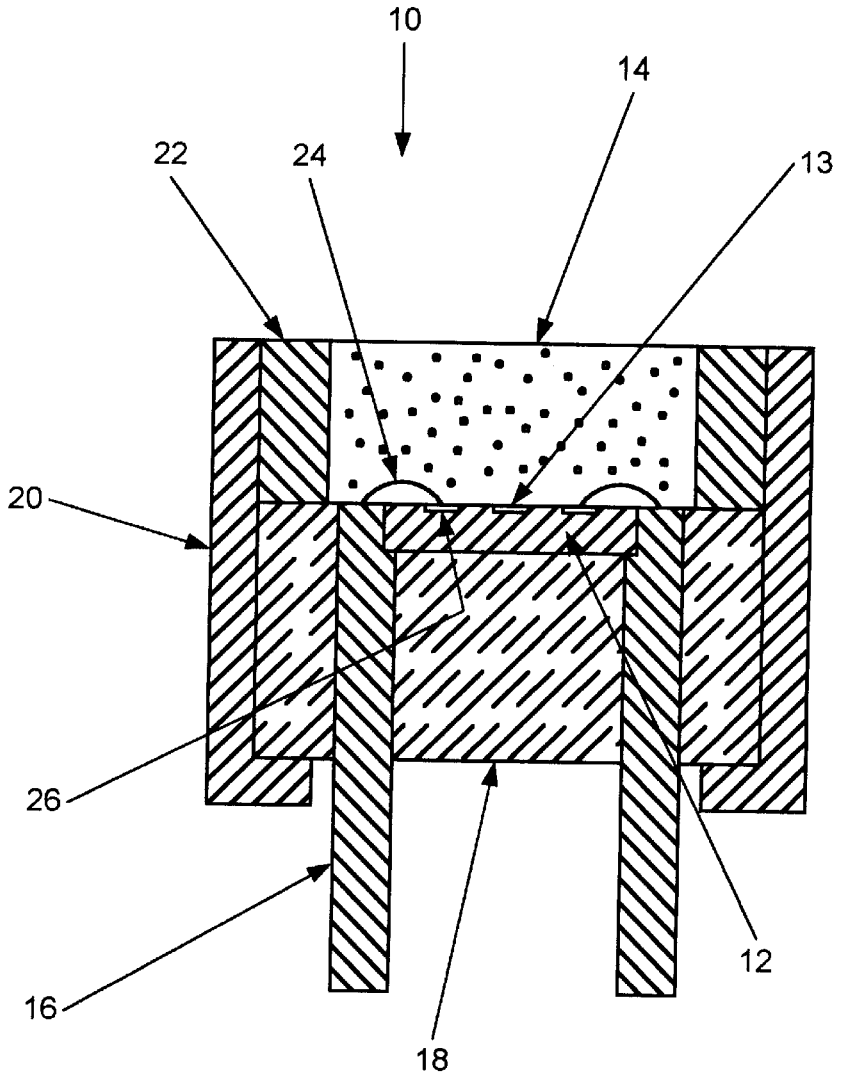
(PRIOR ART) FIGURE 1
FIG. 1 is a cross-sectional side view of a prior art semiconductor bridge device.
Figure 2A:
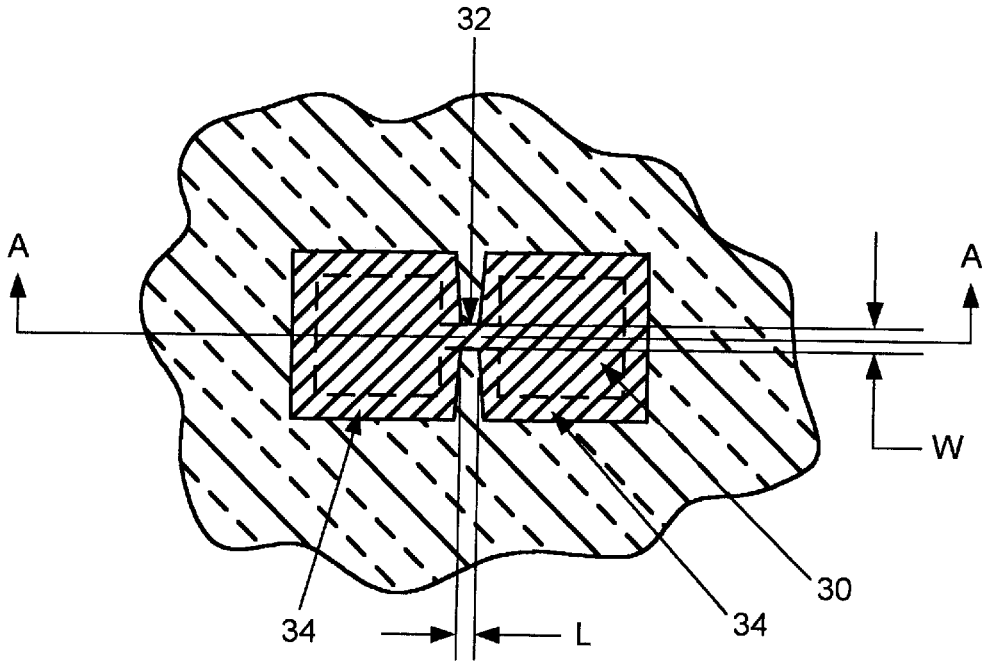
(PRIOR ART) FIGURE 2a
FIG. 2*a* is a top view of a second prior art semiconductor bridge device.
Figure 2B:
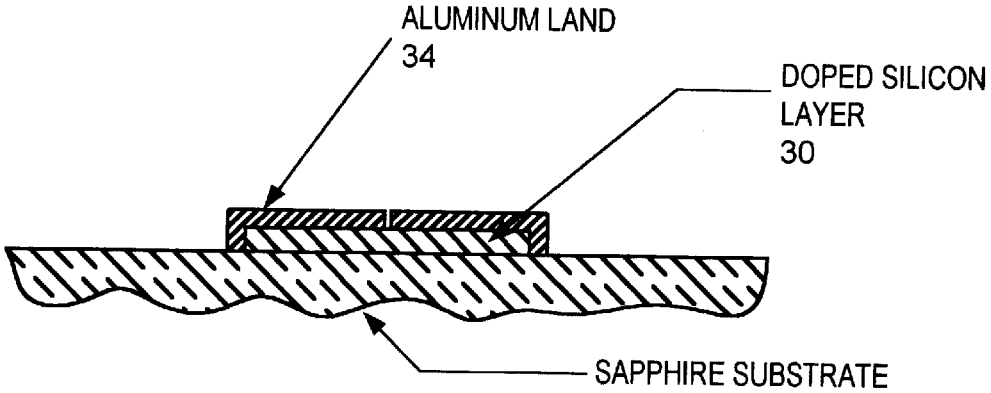
(PRIOR ART) FIGURE 2b
FIG. 2*b* is a cross-sectional side view of the second prior art semiconductor bridge device shown in FIG. 2*a*.
Figure 3:
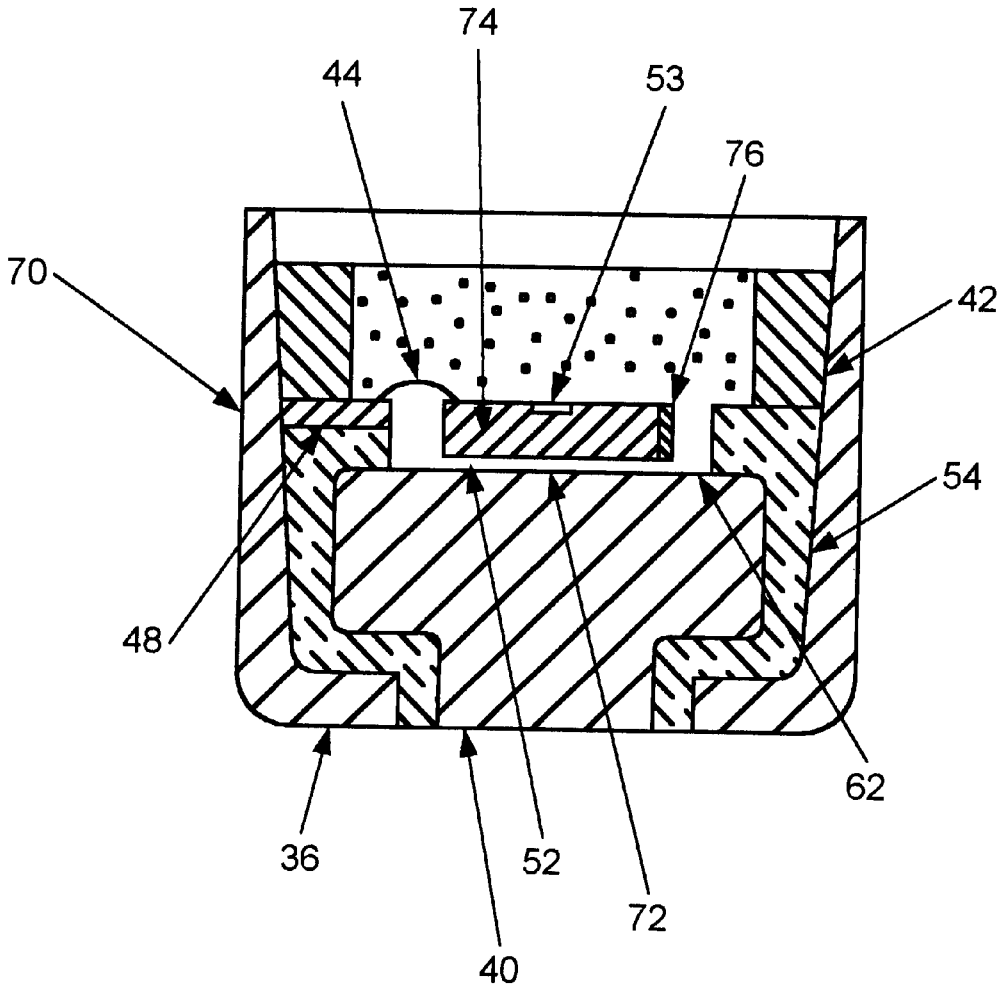
(PRIOR ART) FIGURE 3
FIG. 3 is a cross-sectional side view of a third prior art semiconductor bridge device.
Figure 4A:
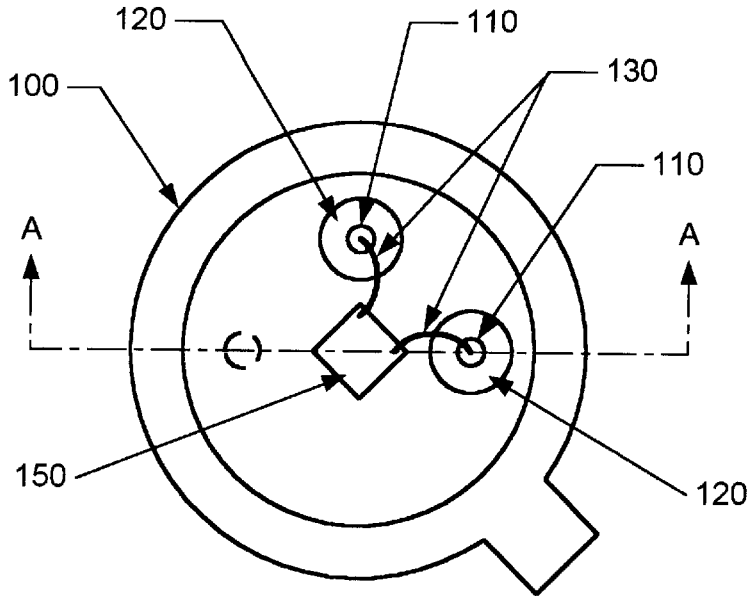
FIG. 4*a* is a top view of the present invention, showing the semiconductor bridge device, connecting wires, and package, but excluding the explosive material and top lid of the package.
Figure 4B:
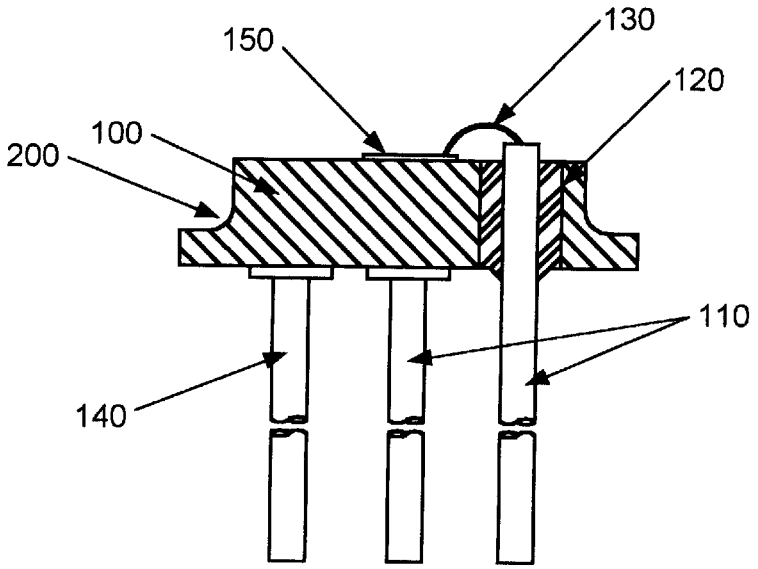
FIG. 4*b* is a side view of the invention taken along the cross-sectional line "A" of FIG. 4*a*.

FIG. 4 illustrates an EED header assembly 200 adapted to house a semiconductor bridge device 150 in accordance with an embodiment of the invention.

The transistor outline (TO) header 100 is made of a steel alloy and is gold plated, as is common practice in the industry. The semiconductor bridge 150 is constructed in accordance with the methods of Hollander, but utilizes small pads of the electrical material which extend beyond the bridge. The electrical material is silicon which is doped so as to make it highly conductive. When assembled, the silicon in the die and gold plating on the header form a eutectic bond when heated, hence providing a good electrical, thermal and mechanical contact to the header, creating one side of the circuit through ground pin 140. The other side of the SCB circuit is redundantly connected to separate feed-through pins 110 by separate wire bonds 130. Feed-through pins 110 are isolated from the header body 100 and from each other by the glass insulators 120.

Since wire bonds 130 are the weakest element of the circuit, an advantage of this invention is that these bonds are redundant, and allow for nondestructive testing after assembly to confirm their integrity. After loading the explosive powder, the resistance between the redundant conductors 110 should remain very low if no damage to the wires or bonds have occurred. Thus, the slightest weakness, dislocation or breakage in the wire or the bonds can be detected by a small positive resistance measured during the test. In other words, one may connect the two leads of an ohmmeter to each of the pins 110. An open circuit or significant positive resistance indicates that one or both of the wire bonds 130 are damaged. A closed circuit indicates a functional device.

Figure 5:
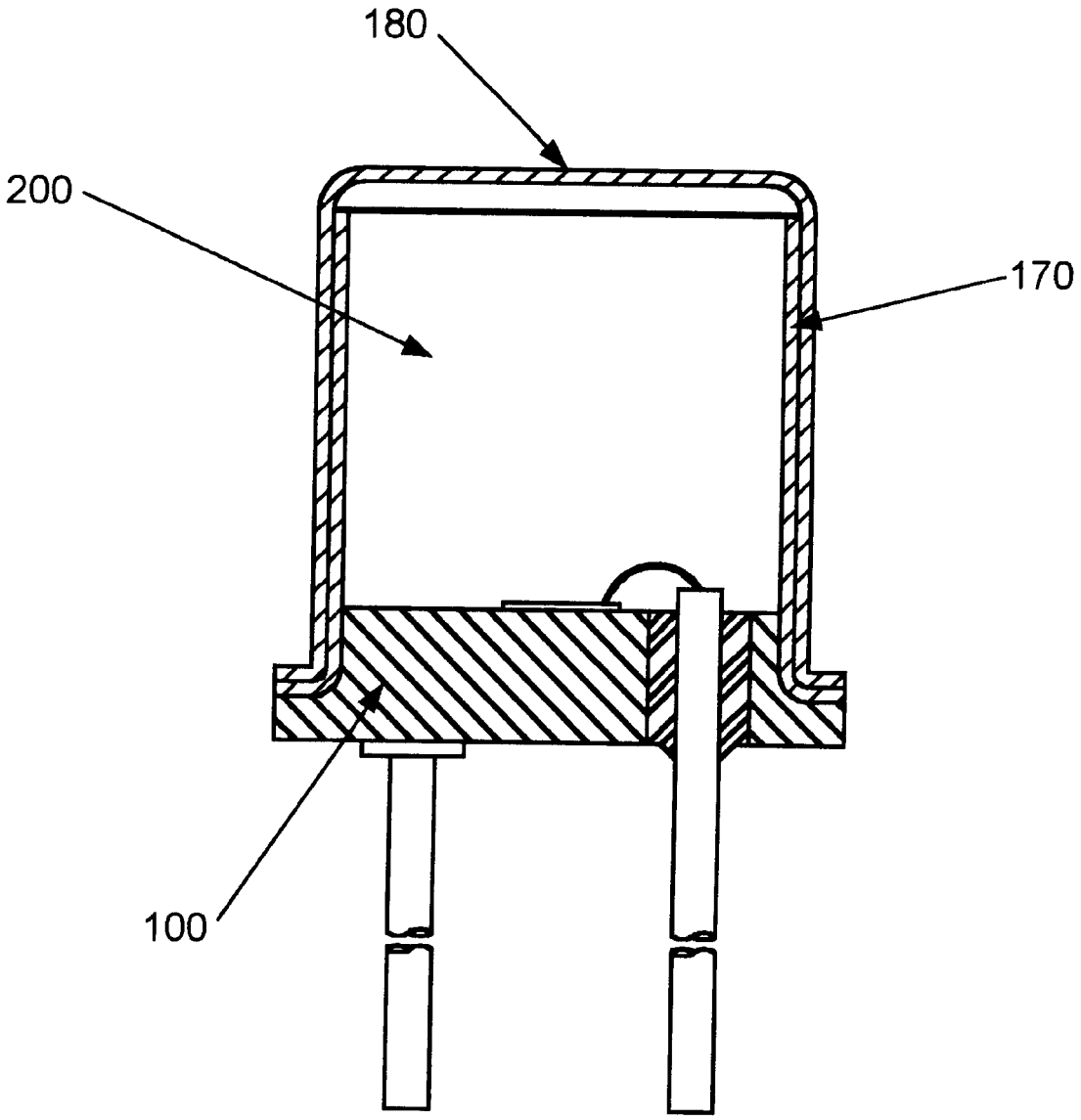
FIG. 5 is a cross-sectional side view of the assembled apparatus of the present invention.

FIG. 5 shows the rest of the EED assembly which is attached to the header assembly described above. A loading sleeve 170 is resistance welded to the header 100. The explosive powder 200 is then loaded and pressed into the sleeve 170. Finally, a cover 180 is welded over the entire EED to create a hermetic seal.

It is a significant advantage of the invention that all of the above assembly processes can be performed with automated equipment readily available in the semiconductor industry. In particular, the process of placing the die on the header, creating the eutectic bond between the die and the header, attaching the connecting wires between the die and the pins, and welding the load sleeve can be performed in a totally automated manner.

Figure 6:
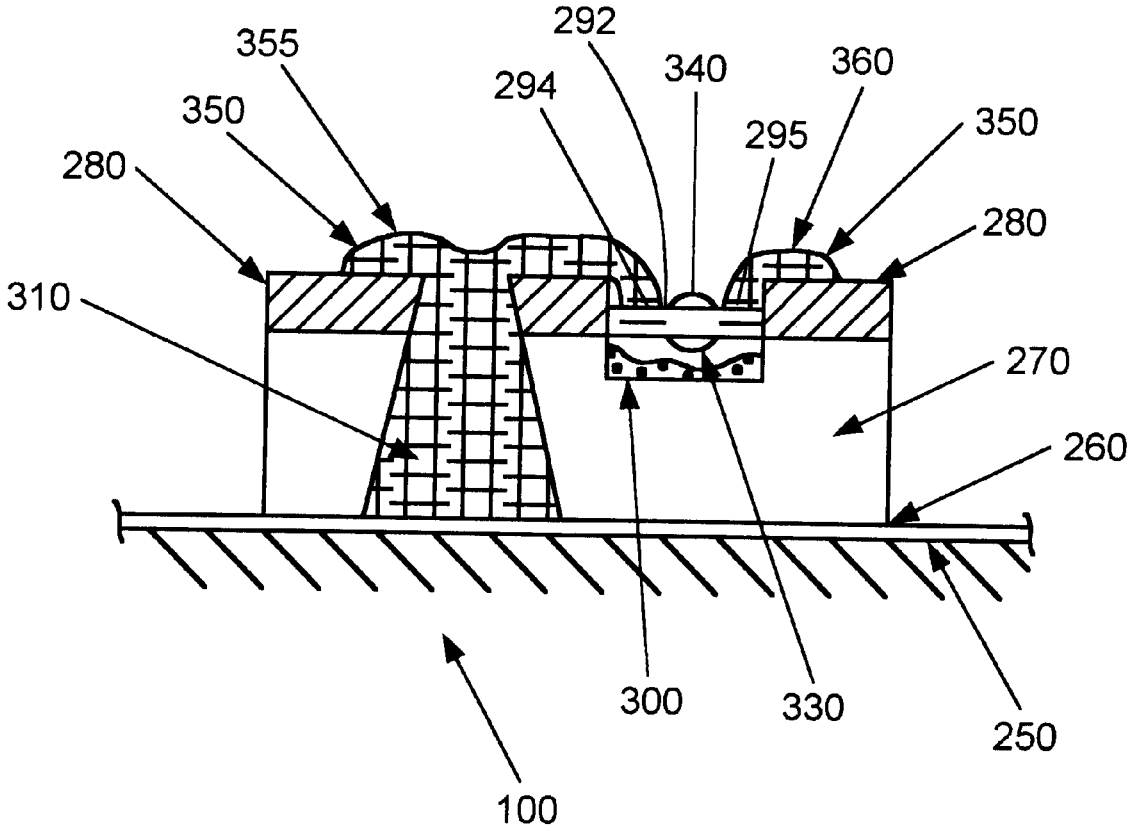
FIG. 6 is a cross-sectional side view of the semiconductor bridge die of the present invention taken along the cross-sectional line "A" of FIG. 7.
Figure 7:
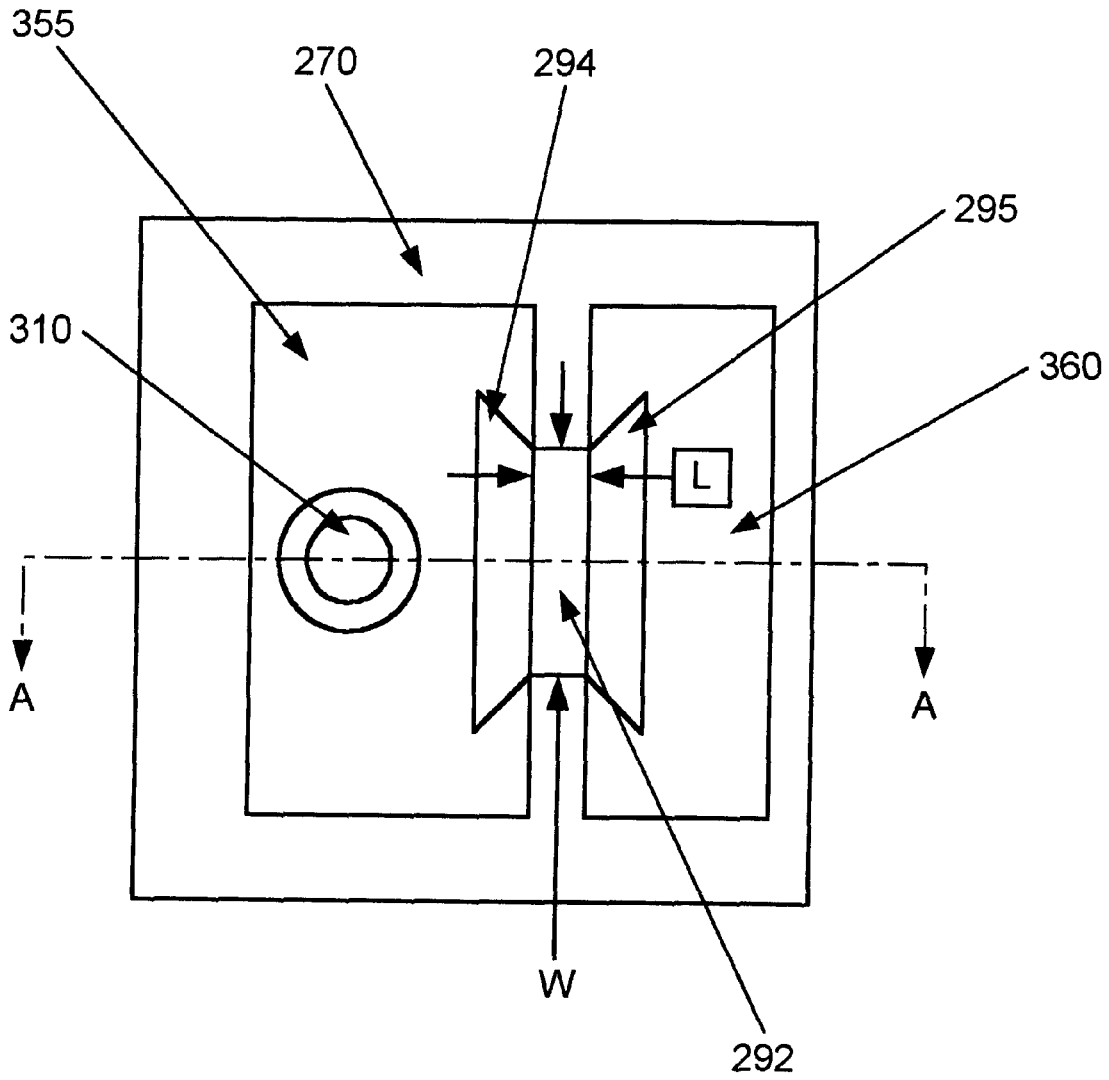
FIG. 7 is a top view of the semiconductor bridge die of the present invention.

FIGS. 6 and 7 (not to scale) describe in greater detail the structure of the SCB die 150 and its attachment to the TO header 100. In this embodiment, the electrical material is heavily doped silicon which covers an area comparable to the bridge size. Therefore, the overall size of the die 270 can be small, approximately 50 mils by 50 mils or less. The substrate material 270 is approximately 5 mils thick and is intrinsic (relatively insulating) silicon with resistivity of approximately 100–200 ohm centimeters.

The SCB is fabricated by the following process. First, a field oxide insulating layer 280 is grown over the surface of the die. The edges of the field oxide 280 are approximately contiguous with the edge of the die 270.

Next, a masking step etches away the field oxide 280 to expose areas 292, 294 and 295, which will form the material of the bridge 292 and connecting pads 294 and 295 to the bridge 292. These exposed areas 292, 294 arid 295 are doped with phosphorus to an approximate concentration of $10^{19}$ to $10^{20}$ atoms/cc to yield a resistivity of approximately 0.8 milliohm-em with a depth of dopant approximately 2 microns. This doping process forms the conducting region 300.

This bridge construction will yield a 1 ohm bridge, which is a standard in the art, if the W/L ratio is approximately 4. Similarly, a resistance of 2 ohms, which is common for automotive air bag initiators, is achieved when W/L is approximately 2. The length L of the bridge determines the voltage at which the bridge will function. For example, a length of 50 microns results in an operating voltage of about 20 volts. The top surface area of each of said pads 294 and 295 is relatively small compared to the bridge 292, preferably not more than twice the top surface area of the bridge 292.

Next, a metallization layer is deposited over pads 294 and 295. (A separate masking layer is used to expose pads 294 and 295.) In the preferred embodiment, the metallization layer comprises a first platinum silicide layer 330, followed by a titanium tungsten alloy 340 and an overplate of gold 350. The gold layer 350 provides for easy wire bonding to wire bonds 130.

In the preferred embodiment, platinum silicide layer 330 is approximately 600 Angstroms thick. This layer is created by the deposition of platinum on the silicon, then sintering for approximately 30 minutes at approximately 615 degrees centigrade. Finally, the remaining pure platinum is etched away leaving only the platinum silicide. The titanium/tungsten alloy layer 340 is approximately 1000 Angstroms thick and is about 85% tungsten and 15% titanium. It is vapor deposited.

Next, a contact (or via) hole 310 is etched through the silicon substrate 270. The back of the substrate is masked, and the contact hole is etched from the back of the substrate to the front. This hole will be 2–3 mils in diameter at the top and 4–5 mils in diameter at the bottom. As can be seen in FIG. 7, the bridge 292 and pads 294 and 295 do not overlap the Contact hole 310 and do not extend as far as the edge of the oxide 280 or substrate 270.

The final gold layer 350 is plated to a thickness of approximately 1.5–2 microns thick over the pads; it also completely fills the contact hole 310. A mask is first applied to the metallization layers 330, 340 and 350 to define separate bonding pads 355 and 360. Gold is then sputtered through the mask onto the front surface of the substrate, and also plated onto the front surface. Gold is also separately plated onto the back surface.

In this manner, one silicon pad 294 is connected to the bridge 292 and is also connected to the header 100 by metal pad 355. In other words, an electrical connection is made from pad 294 through the substrate to the header; metal pad 355 is the only electrical connection between that side of the doped silicon bridge material and the header. The other side of the doped silicon bridge layer is connected to metal pad 360, which is insulated from the substrate 270. Pad 360 is subsequently connected to wires 130.

Thereafter, the wafer is then etched to form individual SCB dies 150. The SCB die is attached to the header surface 100 through a eutectic bond 260 created by depositing a layer of gold 250 on top of the header and bonding the substrate 270 to the gold using conventional techniques, such as those described in the book VLSI Technology by S. M. Sze (2nd Edition). The die's small size and eutectic bond assures that the die will survive the pressure from pressing against the explosive powder. Wire bonds 130 are then attached to the die as described previously.

Figure 8A:
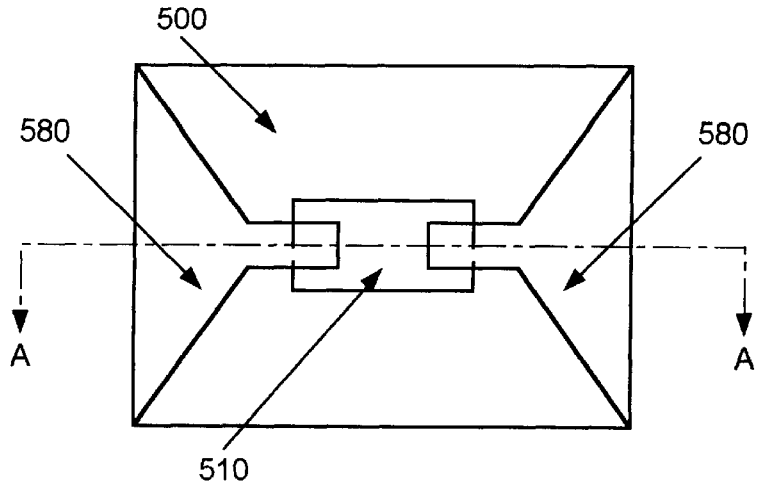
FIG. 8*a* is a top view of an alternative embodiment of the semiconductor bridge die.
Figure 8B:
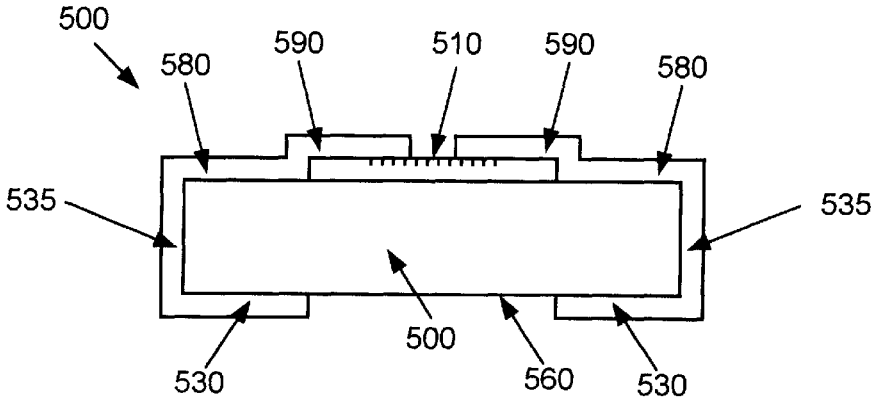
FIG. 8*b* is a cross-section taken along line A—A of FIG. 8*a* showing the substrate. the wrap around conducting layers, and the bridge of the alternative embodiment of the semiconductor bridge die.
Figure 8C:
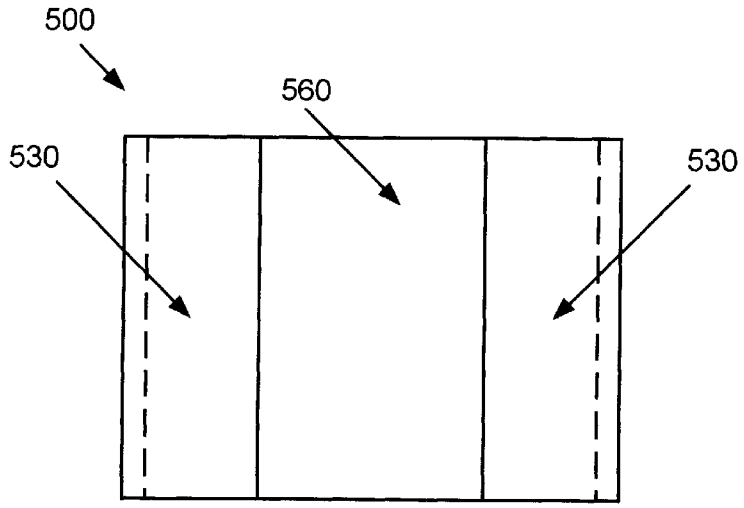
FIG. 8*c* is a bottom view of the alternative embodiment of the semiconductor bridge die.

An improved method of attaching a semiconductor bridge to the header of an electroexplosive device is now described, The method can result in a semiconductor bridge die 500 as shown in FIGS. 8*a*, 8*b*, and 8*c*. As described earlier, an electrical current through a bridge of a die can be used in an electroexplosive device to initiate an explosive powder.

In one embodiment, the bridge 510 may be made of heavily doped silicon as described in U.S. Pat. No. 3,366,055 to Hollander which is hereby incorporated by reference. In an alternative embodiment, the bridge 510 is made of a thin tungsten layer deposited by chemical vapor deposition as described in U.S. Pat. No. 4,976,200 to Benson et al. which is hereby incorporated by reference. For conciseness, this attachment method will be only described as it applies to a doped silicon bridge. However, the method is also applicable to the tungsten/silicon bridge.

FIG. 8 illustrates an embodiment of the die 500. A number of the die 500 can be fabricated from a silicon wafer 5 to 15 cm in diameter and 0.2 to 0.4 mm thick. Favorable results can be achieved when the intrinsic silicon wafer has a resistivity of about 100 ohm-cm or higher. The bridge 510 can be a heavily doped silicon achieving a relatively low resistivity of about $10^{-3}$ ohm-cm.

Figure 9A:
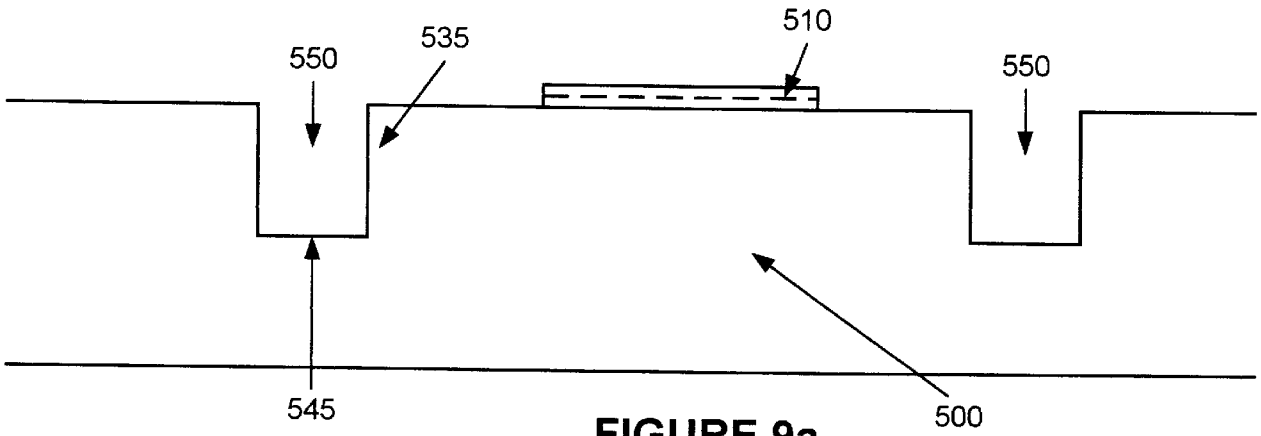
FIG. 9*a* is a cross-section of a portion of the wafer after formation of the bridge thereon and grooves therein.

FIG. 9*a* is a cross-section of part of the silicon wafer. The silicon wafer is oxidized, then implanted with n-type dopant atoms such as phosphorus using a conventional 100,000 volt electron beam technique. The Hollander patent describes other suitable n-type dopants.

Favorable results have been achieved when the dopant concentration is about $10^{19}$ to $10^{21}$ $cm^{-3}$ One preferred dopant concentration is about $10^{20}$ $cm^{-3}$. In one embodiment, the doped silicon wafer is elevated to a temperature of about 1050° C. for approximately 20 minutes resulting in a diffusion depth of about 1 to 3 microns. The diffusion should be in a furnace under an inert atmosphere such as argon gas. After diffusion, hydrofluoric acid removes the oxide on the silicon wafer.

Conventional photolithography defines a pattern for making bridge 510. The mask (not shown) defines an array of patterns so that each die 500 has a length and width of somewhere between 0.5 to 1.0 mm Although the exact dimensions are not critical, each die should be sufficiently large for handling with conventional automated assembly equipment yet small enough to maximize the yield of dies per wafer.

Figure 9B:
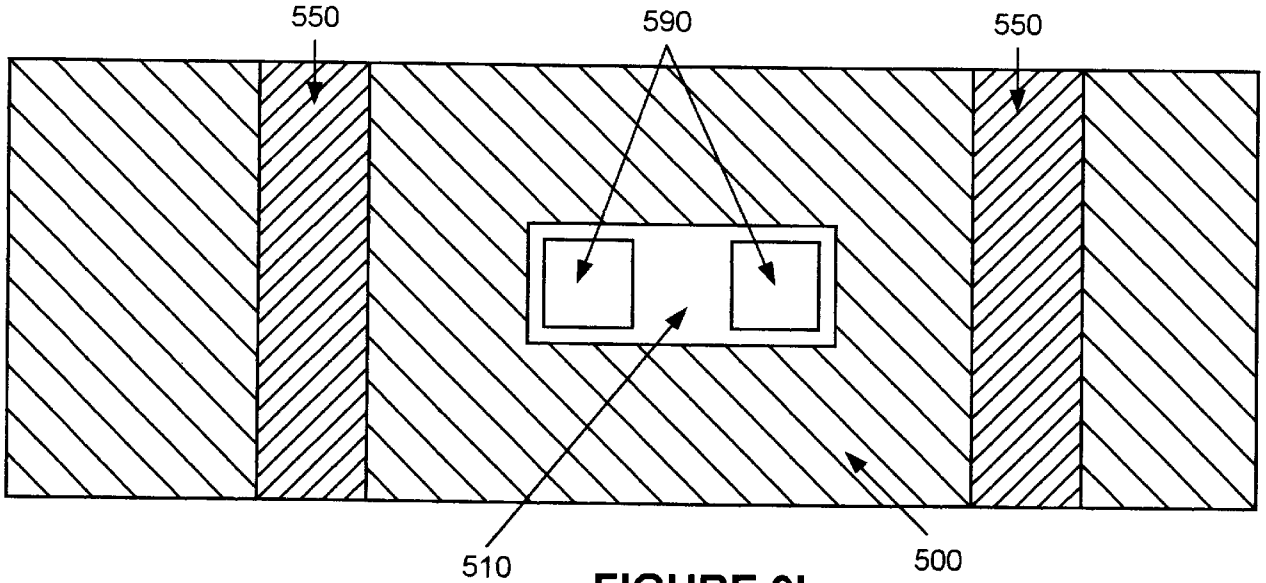
FIG. 9*b* is a top view of the wafer shown in FIG. 9*a*, showing the location of the contact pads on the bridge.

After the bridge 510 is fabricated, a saw cuts parallel grooves 550 into the front of the wafer (FIGS. 9*a* and 9*b*). The bridge 510 can be a reference for aligning the saw. In one embodiment, the grooves 550 have a depth of 0.1 mm, a width of 0.1 mm, and are spaced apart 0.5 to 1 mm in the geometry shown in FIGS. 9*a* and 9*b*. As shown in FIG. 9*a*, the depth of each groove 550 is less than the thickness of the wafer.

After the grooves 550 are formed, conventional photolithography is used to protect area 510 from a etch process. The remainder of the wafer is etched to a depth of 2 to 4 microns. This fully exposes the silicon and forms a mesa, that is, the bridge 510 of heavily doped silicon.

Conventional photolithography techniques expose areas for contact pads 590 for etching. The silicon wafer is then exposed to a palladium electron beam process. Deposited palladium reacts with the exposed silicon in areas 590 forming a palladium silicide layer. An ultrasonic bath lifts the non-reacted palladium off the wafer leaving palladium silicide contact pads 590. A mask then covers the bridge 510 and exposes the rest of the wafer.

A conventional titanium/tungsten layer is sputtered on the exposed areas to a depth of about 0.1 to 0.2 microns. This forms an ohmic contact. This is followed by a sputtered gold layer of about the same depth. Gold is selectively plated for conducting layers 580 and contact pads 590 as shown in FIG. 8. A suitable gold plating thickness is about 6 to 8 microns.

The next process step removes a gold layer from the front of the wafer. As shown in FIGS. 8*a* and 8*b*, each conducting layer 580 extends around the edge 535 into the bottom 545 of a groove 550 (FIG. 9*a*). The front of the wafer is etched for 5–10 seconds removing 0.1 to 0.2 microns of gold. A wet etch removes the exposed titanium/tungsten. Although a thin gold layer is removed, a thick layer of gold remains on the desired surfaces of groove 550.

The wafer is then turned over for processing of the back surface. The back of the wafer can be alternately sandblasted and etched until the gold plating extending into the bottom 545 of each groove 550 is visible from the back of the wafer. A suitable material for sandblasting is aluminum oxide particles of about 18 micron average diameter. Any oxide layer is then etched off the wafer.

A nickel-chromium sputter and a gold sputter is then applied, each having a thickness of about 0.1 to 0.2 microns. Gold is plated to a thickness of 0.5 to 2 microns forming a "wrap around conductor layer" extending from the front to the back surface of the wafer. As shown in FIGS. 8*a* and 8*b*, each conducting layer 580 ultimately contacts bridge 510 at a contact pad 590, goes around an edge 535 and extends to a back surface 530 of the die 500.

It should be noted that the conducting layer 580 can be of aluminum or gold. Gold is preferred, however, for soldering the die 500 to a ceramic substrate 600 (FIG. 10).

The next step is to mask and etch away the metallization over a strip 560 (FIG. 8*c*) on the back of the wafer so as to restrict the conducting layers 580 to surfaces 530 on tie back surface of the die.

The wafer is then turned back over. A saw separates the wafer into individual die 500 by cutting grooves that are perpendicular to the parallel grooves 550 cut earlier. Each die 500 is ready for mounting on a ceramic substrate 600 as shown in FIGS. 10*a* (i.e. bottom view) and 10*b* (i.e. top view), which will be in turn mounted on the header 100 (FIG. 11).

Figure 10A:
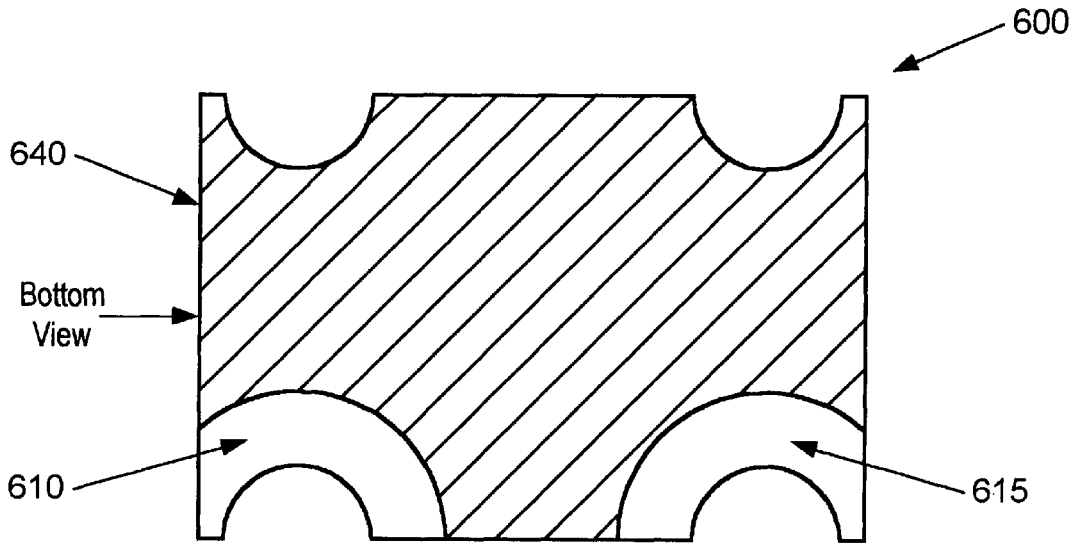
FIG. 10*a* is a bottom view of a ceramic substrate which is a mounting surface for the header of FIG. 11.
Figure 10B:
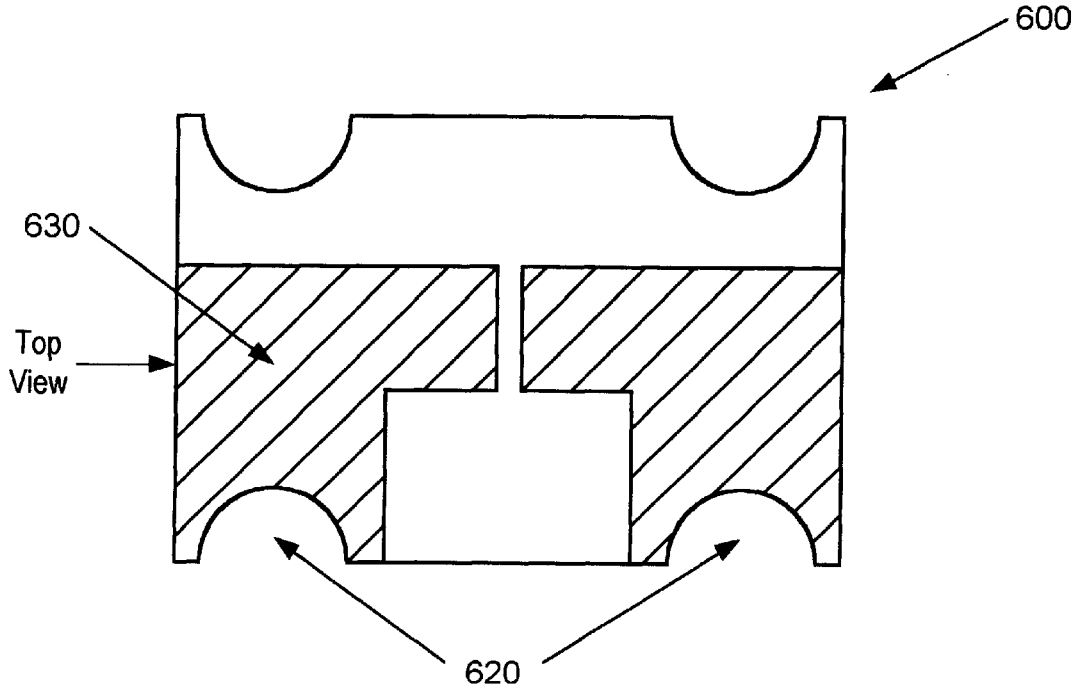
FIG. 10*b* is a top view of the ceramic substrate. In one embodiment, it provides the electrical connections between the pins and the conducting layers on the back surface of the semiconductor bridge die.

As shown in FIG. 10, the ceramic substrate 600 includes a metallization pattern 630 to make the proper electrical connections. Solder or conductive epoxy makes the electrical connection between the pins 110 and the metallization pattern 630. The metllization pattern 640 on the back of ceramic substrate 600 is soldered to the header 100 and spaced from pin connecting recesses 620 in areas 610 and 615 (FIG. 10*a*) to avoid shorting the metallization pattern 630 to the header 100. The metallization pattern 630 electrically connects the pins 110 to the conducting layers 580 on the back surfaces 530 of the die 500.

Figure 11:
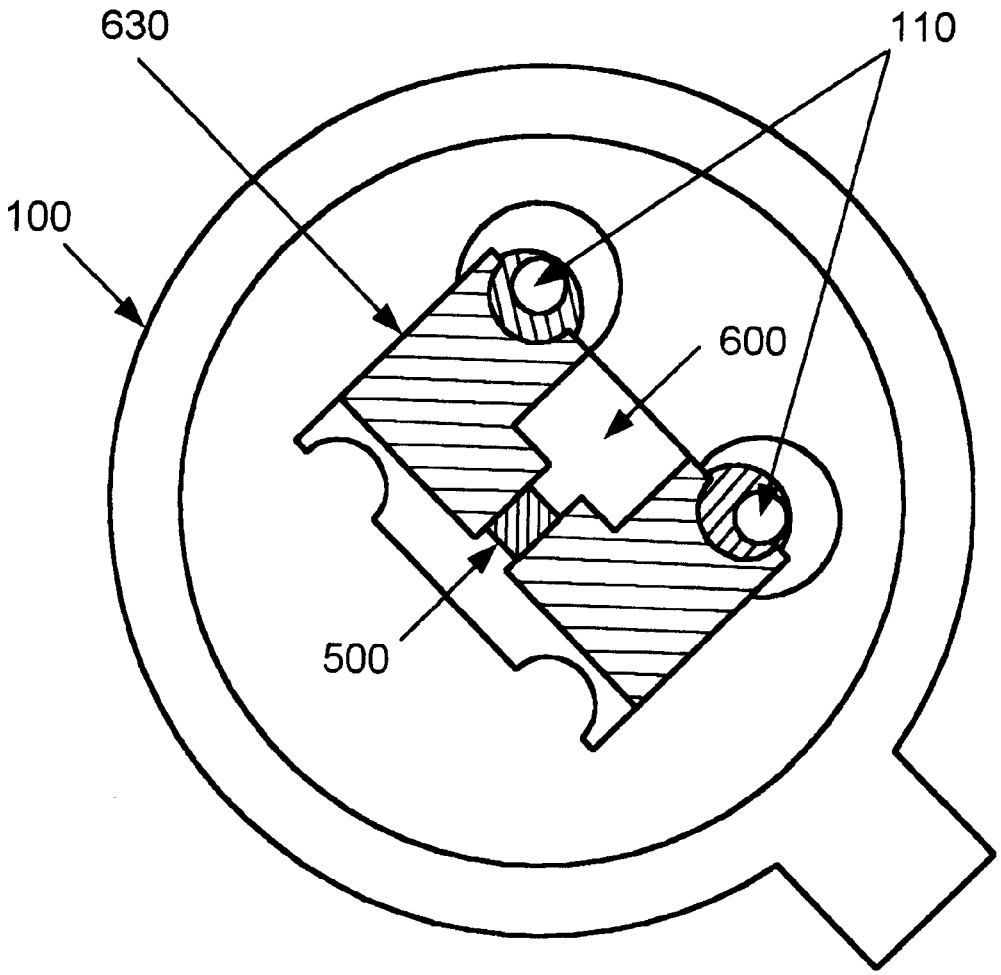
FIG. 11 is a top view of the alternative embodiment illustrating the relationship of the semiconductor bridge die, the header, metallization patterns, and pins.

FIG. 11 illustrates a header 100 attached to the ceramic substrate 600 and electrically connected to pins 110. The final assembly is made by soldering or using conducting epoxy between (1) the surface of the header 100 and the metallization pattern 640; (2) the pins 110 and the metallization pattern 630; and (3) the metallization pattern 630 and the conducting layers 580 on back surfaces 530 of the die 500. The header 100 can be now loaded with explosive powder 14 to make an electroexplosive device as described earlier.

The present invention includes another improved method of mounting the semiconductor bridge die to the header of an electroexplosive device. As mentioned earlier, an explosive powder 200 (FIG. 5) is consolidated under high pressure in a loading sleeve 170 to optimize the ignition characteristics of the explosive powder. Unfortunately, when the explosive powder is consolidated some SCB die will break producing an open circuit. To understand the reasons for breakage, it is helpful to review the method of mounting the SCB die 500 on the ceramic substrate 600 as illustrated in FIGS. 8–11.

Figure 12:
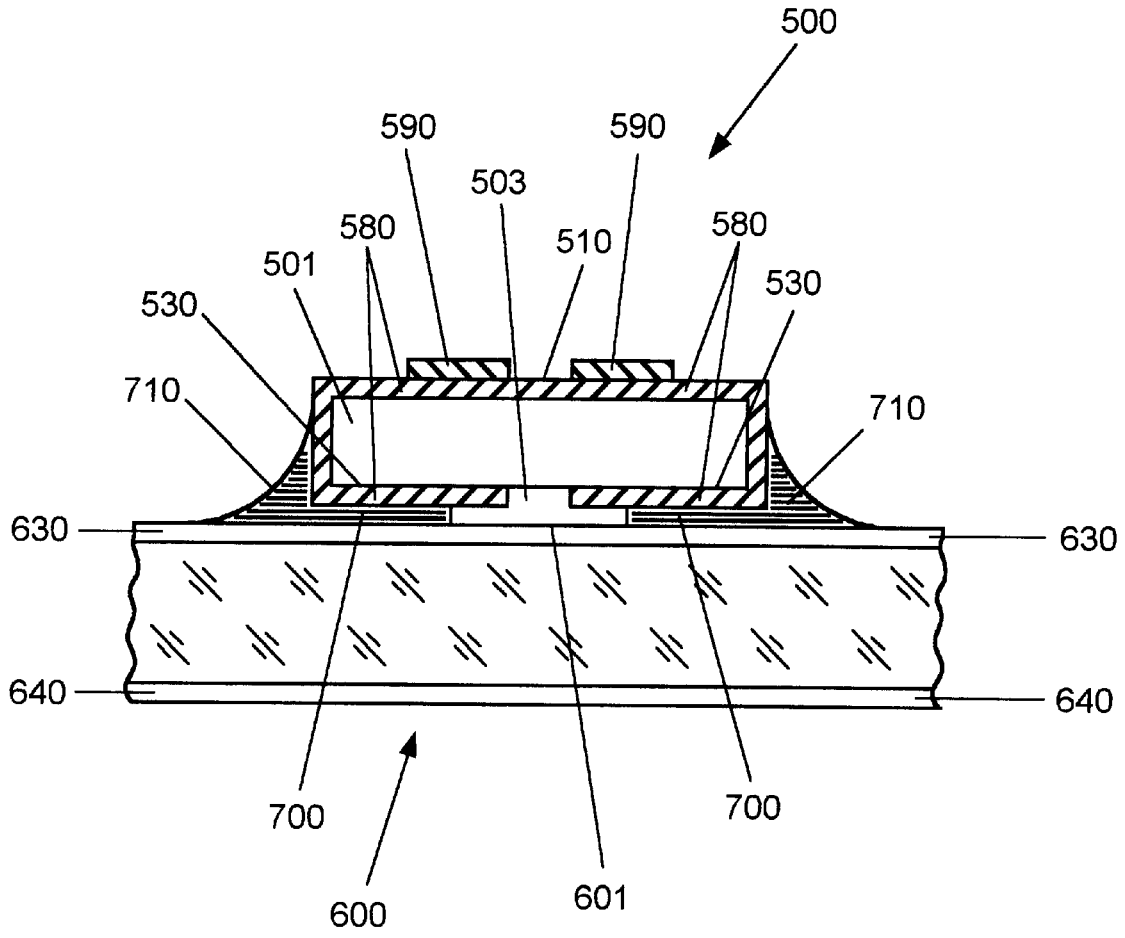
FIG. 12 is a cross-sectional view of a SCB die mounted on a ceramic substrate, wherein the SCB die includes an unsupported groove.

FIG. 12 illustrates a cross-sectional view of a SCB die 500 mounted on a ceramic substrate 600. The SCB die 500 includes a semiconductor bridge 510 of a doped region in a silicon substrate 501 and conducting layers 580 which connect the bridge 510 to contact pads 590. The conducting layers 580 extend from the contact pads 590 to the back surfaces 530 of the SCB die 500. The SCB die 500 is mounted on the ceramic substrate 600 by applying solder 700, or preferably a thermally conductive epoxy, between the conducting layers 580 and the metallization pattern 630 of the ceramic substrate 600. The text and accompanying FIGS. 8–11 describe details of this method of making a SCB die and mounting it on a ceramic substrate The ceramic substrate 600 can be obtained from Delta V Associates in Campbell, Calif. For lateral support solder 710 is applied to the side walls of the SCB die 500 as shown in FIG. 12.

This method of mounting produces advantages of ease of manufacture, but also results in a built in groove 503 on the back surface of the SCB die 500 and cavity 601. The high consolidation pressure of the explosive powder (not shown) exerts a load on the SCB die 500. At the same time, the unsupported groove 503 and the cavity 601 function as a cantilever which induces a bending stress within the SCB die 500. Because silicon has a high compressive strength and a low tensile strength, a significant fraction of the SCB die 500 tested with unsupported grooves break under the conditions given in Table I which also indicates that the number of breakages increased in proportion to the consolidation pressure of the explosive powder:

TABLE I

SCB DIE MOUNTING METHOD TEST RESULTS

| units broken/total units tested Consolidation | ZPP + B HLX 14563-01 | | ZPP + B CJP-5 | | ZPP CJP-7 |
|---|---|---|---|---|---|
| Pressure | FSSM * | FSEM * | FSSM * | FSEM | TESM |
| 1,000 psi | 1/5 | 1/3 | 1/5 | 0/5 | 0/3 |
| 2,500 psi | 4/5 | — | 1/5 | 0/5 | 0/3 |
| 5,000 psi | 5/5 | — | 3/5 | 0/5 | 0/3 |
| 7,500 psi | 5/5 | — | 3/5 | 0/5 | 0/3 |
| 10,000 psi | 5/5 | — | 3/5 | 0/5 | 0/3 |

Note:
ZPP + B Bindered $ZrKClO_4$
ZPP Unbindered $ZrKClO_4$
* SCB die with unsupported groove
FSSM Flat ceramic surface/solder mount
FSEM Flat ceramic surface/epoxy mount (i.e. less than 30 minutes curing epoxy)
TESM Trench ceramic/epoxy and solder mount (i.e. less than 30 minutes curing epoxy)

All the following explosive powders, i.e. pyrotechnic compositions in weight percentages, are manufactured by Quantic Industries, Inc. in San Carlos, Calif.:

| | HLX 14563-1 | CJP-5 | CJP-7 |
|---|---|---|---|
| Zr | 53.0% | 46.5% | 47.0% |
| $KClO_4$ | 42.6% | 52.5% | 50.0% |
| Viton B | 5.0% | 0.0% | 2.0% |
| Graphite | 0.0% | 1.0% | 1.0% |

Figure 13:
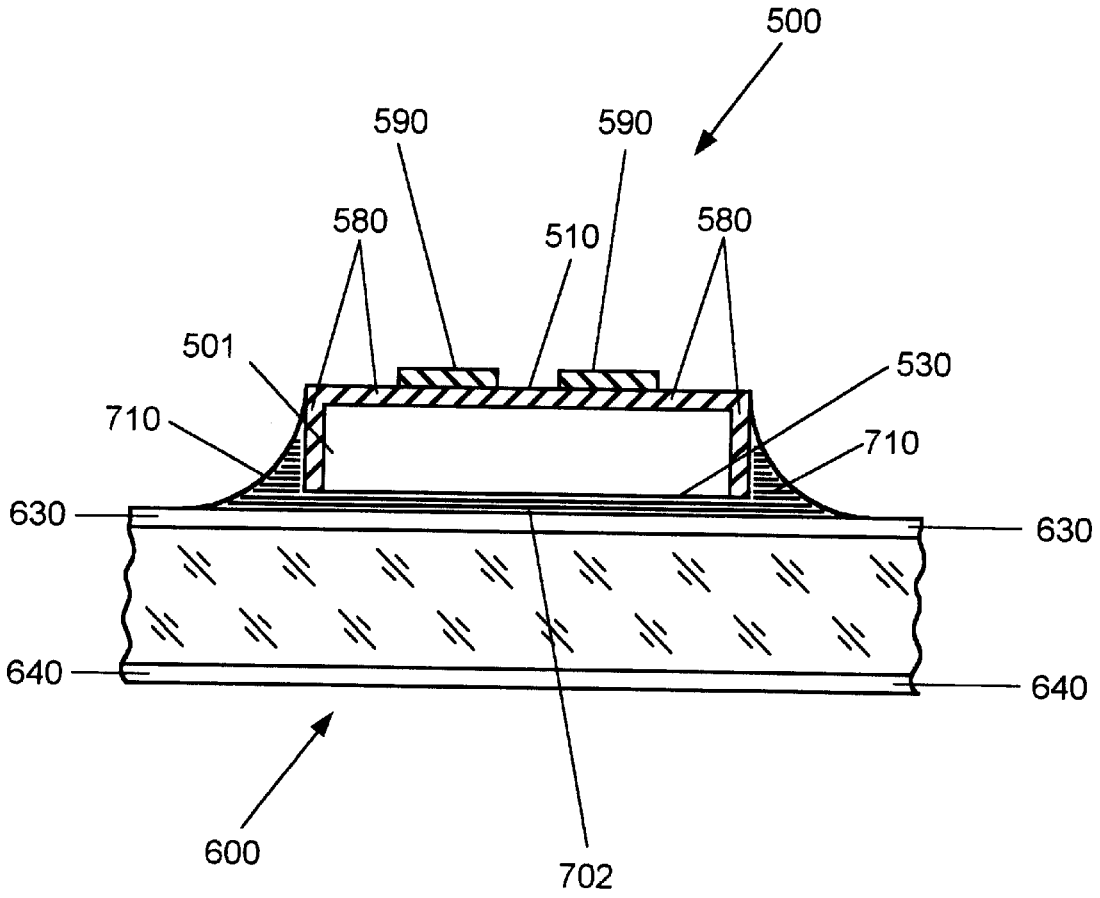
FIG. 13 is a cross-sectional view of the SCB die mounted on a ceramic substrate, wherein the unsupported groove in the SCB die is removed and the cavity filled with an adhesive epoxy.

After inspecting the metallization patterns 630 on the ceramic substrate 600 and finding no surface anomalies, applicants recognized the breakage problem was being caused by the unsupported groove 503 and cavity 601 under the SCB die 500 and needed to be eliminated by removing the groove 503 as well as not plating the back surface of SCB die 500. In addition, an adhesive epoxy had to be used rather than solder to mount SCB die 500 onto the ceramic substrate 600 due to the absence of plated conducting layer 580 which provides wetting of the solder. Applicants removed the groove 503, removed the conducting layers 580 on the bottom of the SCB die 500, and filled the cavity 601 with an adhesive epoxy 702 as shown in FIG. 13. However, this modification results in no apparent improvement (see Table I, column 2). Further, the breakage problem was worse for bindered $ZrKClO_4$ (HLX 14563-1) having various sizes of hardened granules than for the unbindered form of $ZrKClO_4$ (CJP-5). After inspecting the broken SCB die under a 70X magnification microscope, applicants recognized the breakage was being caused by a shear stress induced by lateral movement of the SCB die 500 during the consolidation of the explosive powder.

The first trial with the unplated back surface yielded no apparent improvement in the structural integrity of the SCB die 500 during consolidation operation. However, it was discovered that employing a long time curing epoxy (i.e. curing in greater than 30 minutes) without applying pressure on the SCB die 500 during the curing cycle resulted in the light weight SCB die 500 floating above the epoxy layer and an air bubble forming under the SCB die 500. Therefore, the consolidation operation was moving the SCB die and causing breakage. After this, applicants changed to a fast curing adhesive epoxy (i.e. curing in less than 30 minutes) such as the 2 Ton Clear Epoxy manufactured by Devcon Corporation, in Danvers, Mass. and applied pressure during the initial curing of the epoxy This method yielded no breakage of the SCB die 500 for the consolidation of unbindered $ZrKClO_4$ (CJP-5) in the range of 2,500 to 10,000 psi as indicated in Table I above.

Figure 14:
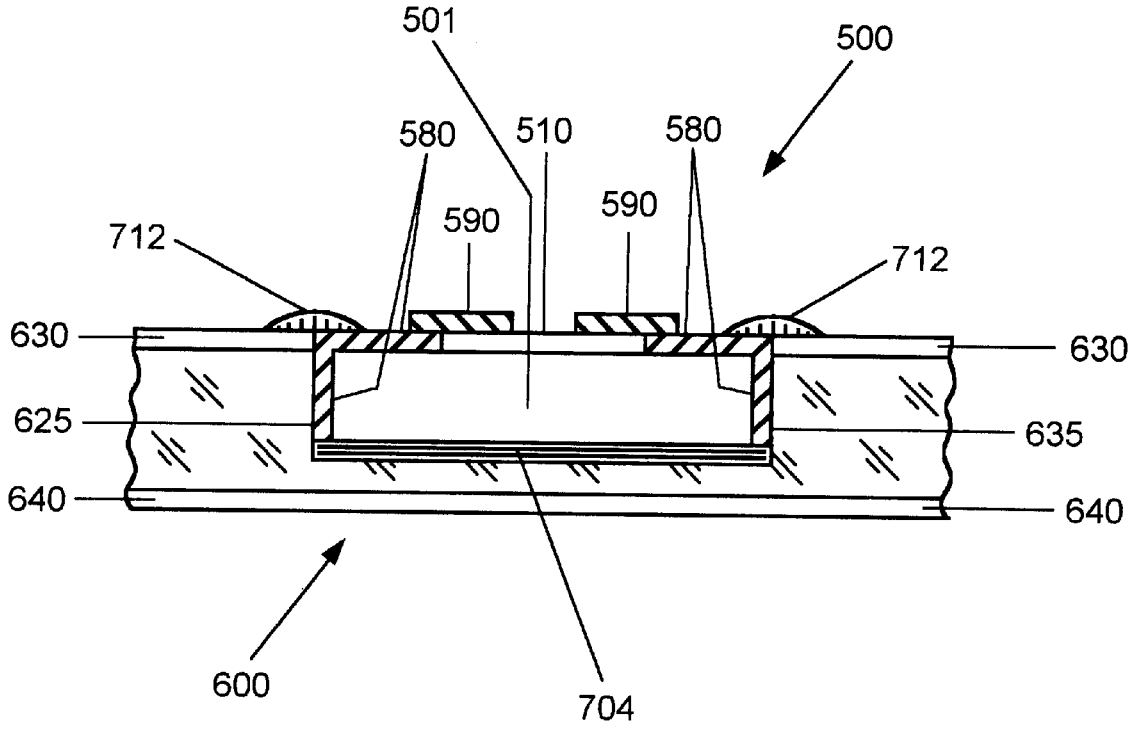
FIG. 14 is a cross-sectional view of the SCB die mounted within a trench of the ceramic substrate.
Figure 15:
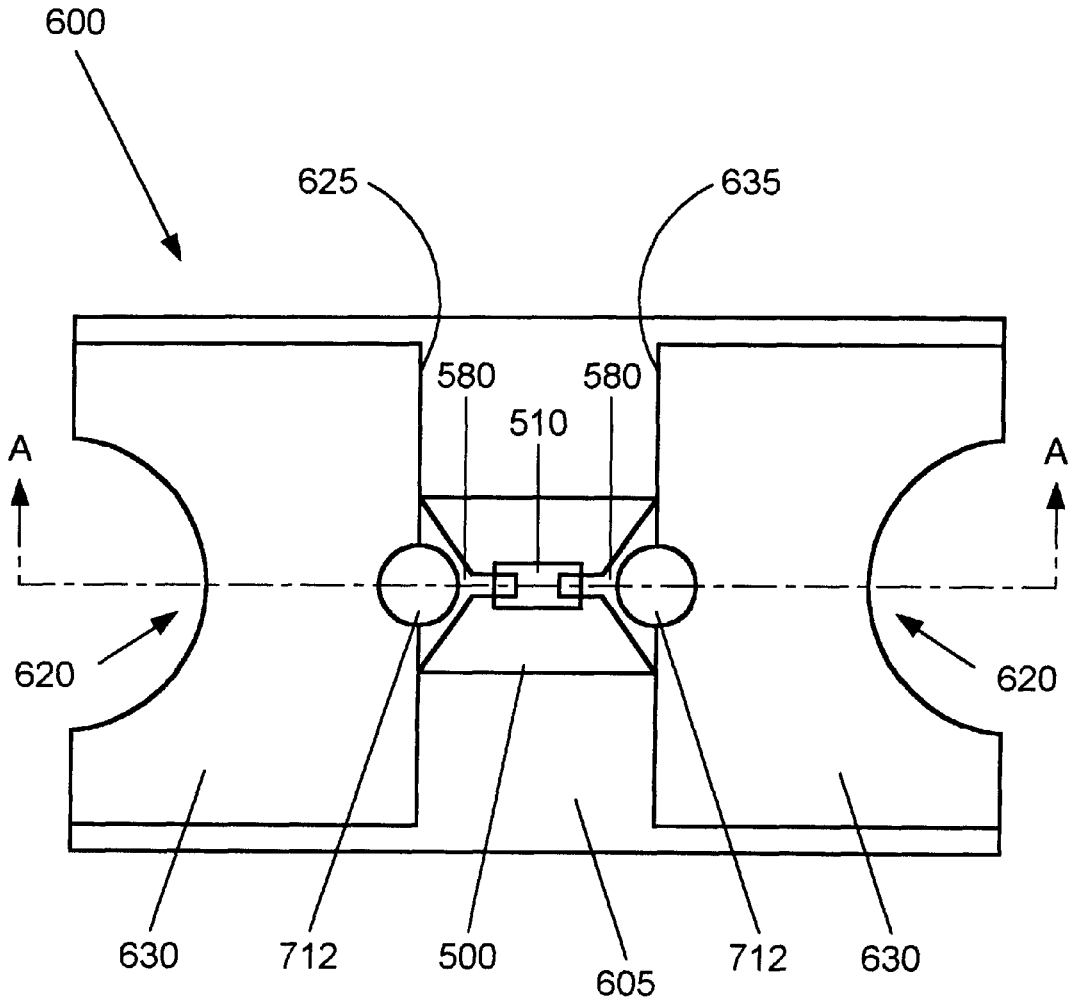
FIG. 15 is a top view of the SCB die mounted within the trench of the ceramic substrate.
Figure 16:
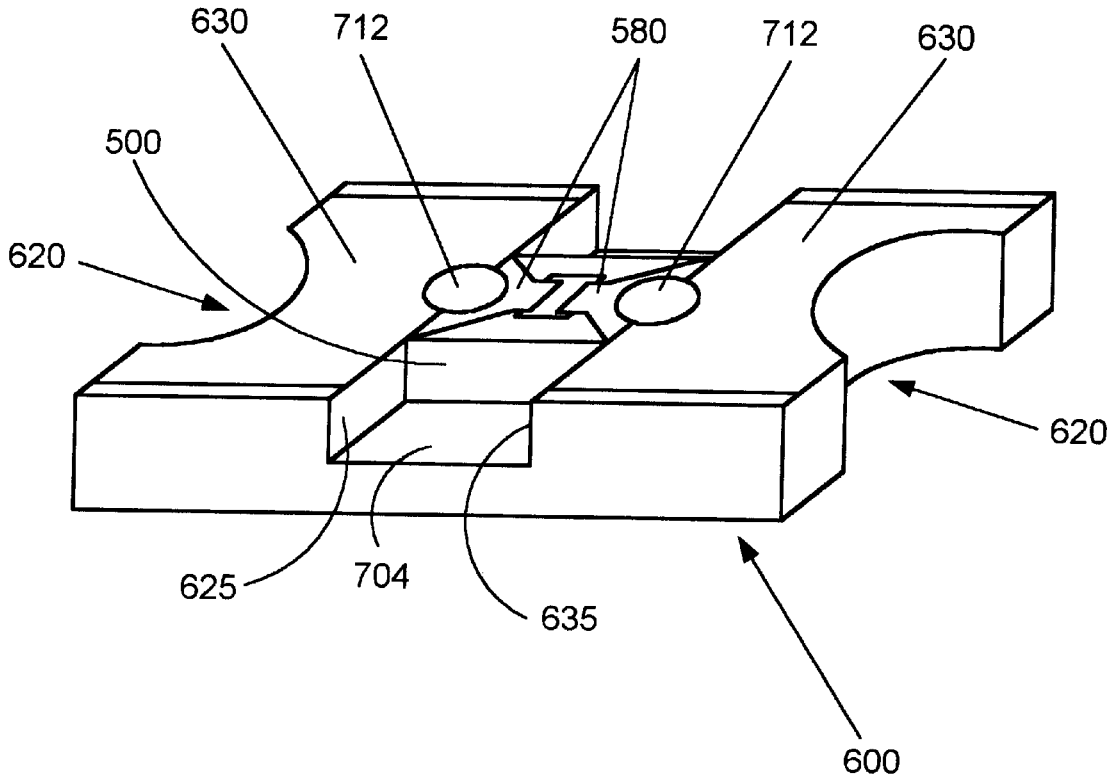
FIG. 16 is a perspective view of the SCB die mounted within the trench of the ceramic substrate.

FIGS. 14–18 illustrate an improved embodiment for mounting the SCB die 500 in a trench 605 in the ceramic substrate 600. FIG. 14 is a cross-sectional view taken on the line A—A of FIG. 15. A perspective view of the same embodiment is shown in FIG. 16. As shown in one or more of FIGS. 14–16, the ceramic substrate 600 includes a trench 605 to ease mounting the SCB die 500 in the ceramic substrate 600, provide a more solid adhesive epoxy surface 704 than solder, and provide lateral support walls 625 and 635 to avoid lateral shifting of the SCB die 500 when the explosive powder (not shown) is consolidated on the SCB die 500. A suitable fast curing adhesive epoxy 704 is Devcon Corporation's 2 Ton Clear Epoxy. The trench 605 can be cut by a conventional saw suitable for cutting a ceramic or formed in the green stage of the ceramic manufacturing. In mounting the SCB die 500 in the ceramic substrate 600, the SCB die 500 was placed in the trench 605 of the ceramic substrate 600 using the fast curing epoxy 704 as described above. Solder 712 or conductive epoxy was applied to the conducting layers 580 and metallization patterns 630 of the ceramic substrate 600 to reinforce the electrical connections between the SCB die 500 and the ceramic substrate 600. This mounting method yielded no breakage of the SCB die 500 for the pressing of bindered $ZrKClO_4$ (CJP-7) in the range of 2,500 to 10,000 psi as indicated in Table I above.

Figure 17A:
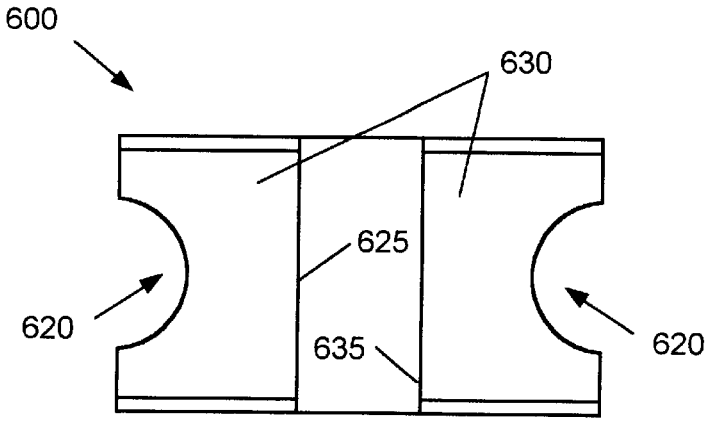
FIG. 17*a* is a top view of the ceramic substrate.
Figure 17B:
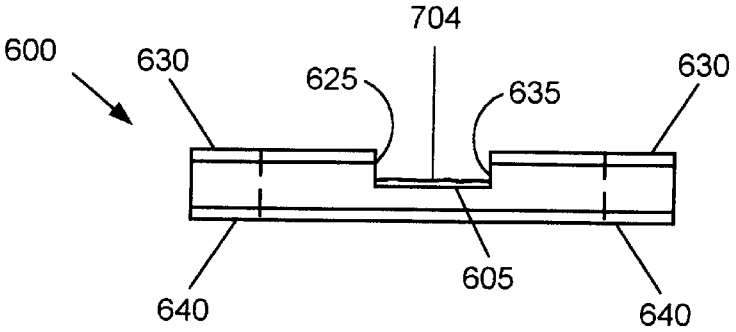
FIG. 17*b* is a cross-sectional view of the ceramic substrate.
Figure 17C:
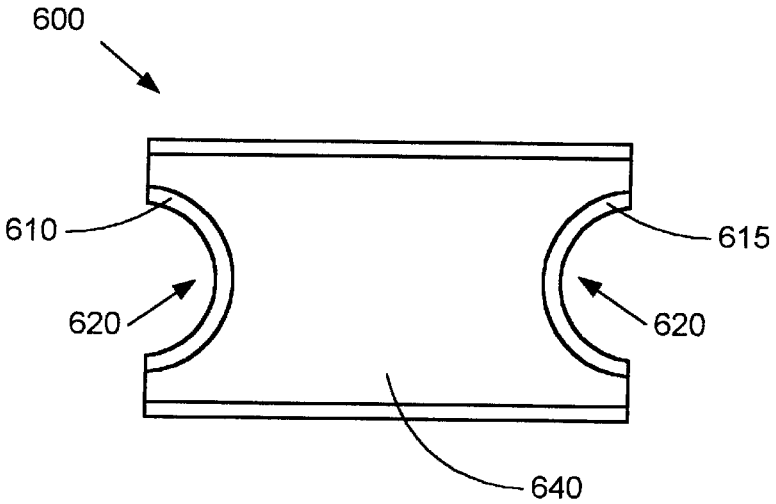
FIG. 17*c* is a bottom view of the ceramic substrate.
Figure 18:
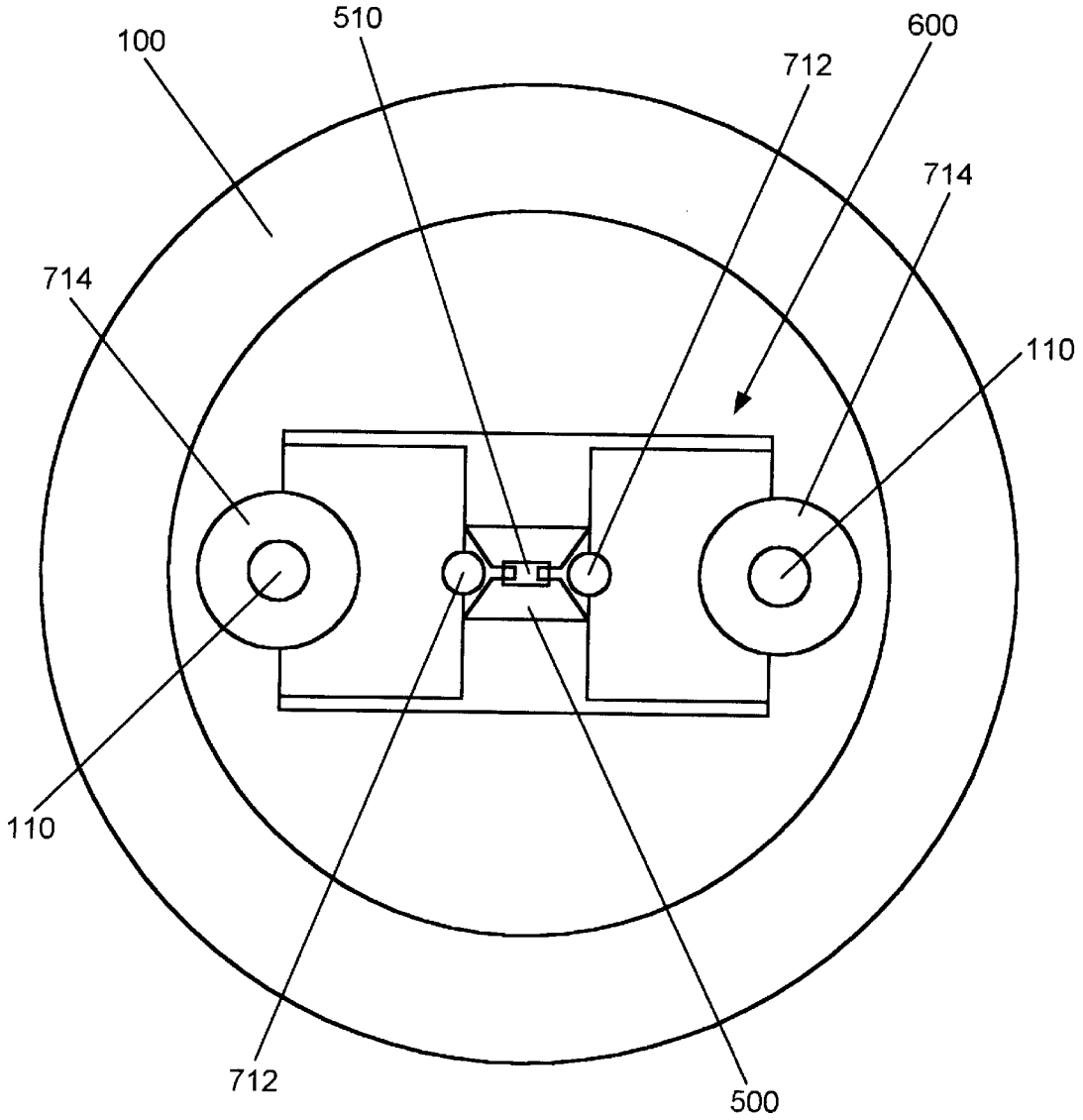
FIG. 18 illustrates the relationship between the header, the ceramic substrates the SCB die and the pins.

FIGS. 17*a*, 17*b*, and 17*c* illustrate a ceramic substrate 600 suitable for mounting the SCB die shown in FIGS. 14–16. As shown in the top view in FIG. 17*a*, the ceramic substrate 600 includes metallization patterns 630 to make the proper electrical connections between the pins 110 (FIG. 18) and the SCB die 500 (FIG. 18). FIG. 17*b* illustrates that in the preferred embodiment the ceramic substrate 600 includes a trench 605 lined with an adhesive epoxy 704. Although it is not necessary, it is preferred that the trench 605 run the entire width of the ceramic substrate 600 and have a depth of approximately 4 mils. The lateral spacing between the support walls 625 and 635 and the SCB die 500 leaves a gap between the SCB die 500 and each lateral support wall 625 and 635 of between 10 to 20 mils. The SCB die 500 preferably fits snugly in the trench 605 without inducing stress in the SCB die. Preferably, when the SCB die 500 is mounted in the trench 605 lined with the epoxy 704 on the bottom of the trench, the upper surface of SCB die 500 is flush or substantially flush with the metallization patterns 630 of the ceramic substrate 600 as shown in FIG. 16. As shown in FIGS. 17*c* and 18, the metallization pattern 640 on the back of the ceramic substrate 600 is soldered to the header 100 and spaced from pin correcting recesses 620 in areas 610 and 615 to avoid shorting the metallization patterns 630 to the header 100. The electrical connection between the metallization patterns 630 and the pins 110 is further reinforced by a conductive epoxy or solder 714 as shown in FIG. 18, a top view of the final assembly.

FIGS. 14–18 together illustrate the relationship between the header 100, the ceramic substrate 600, the SCB die 500 and the pins 110. Thus, the SCB die assembly is made by (1) soldering or using thermally conductive epoxy between the surface of the header 100 and the metallization pattern 640; (2) soldering or using conductive epoxy between the pins 110 and the metallization patterns 630; (3) mounting the SCB die 500 in the trench 605 after the trench 605 is coated on its bottom surface with an adhesive epoxy 704; and (4) soldering or using conductive epoxy between the metallization patterns 630 and the conducting layers 580. The header 100 can be now loaded with an explosive powder as described below to make an electroexplosive device as described earlier.

Figure 19:
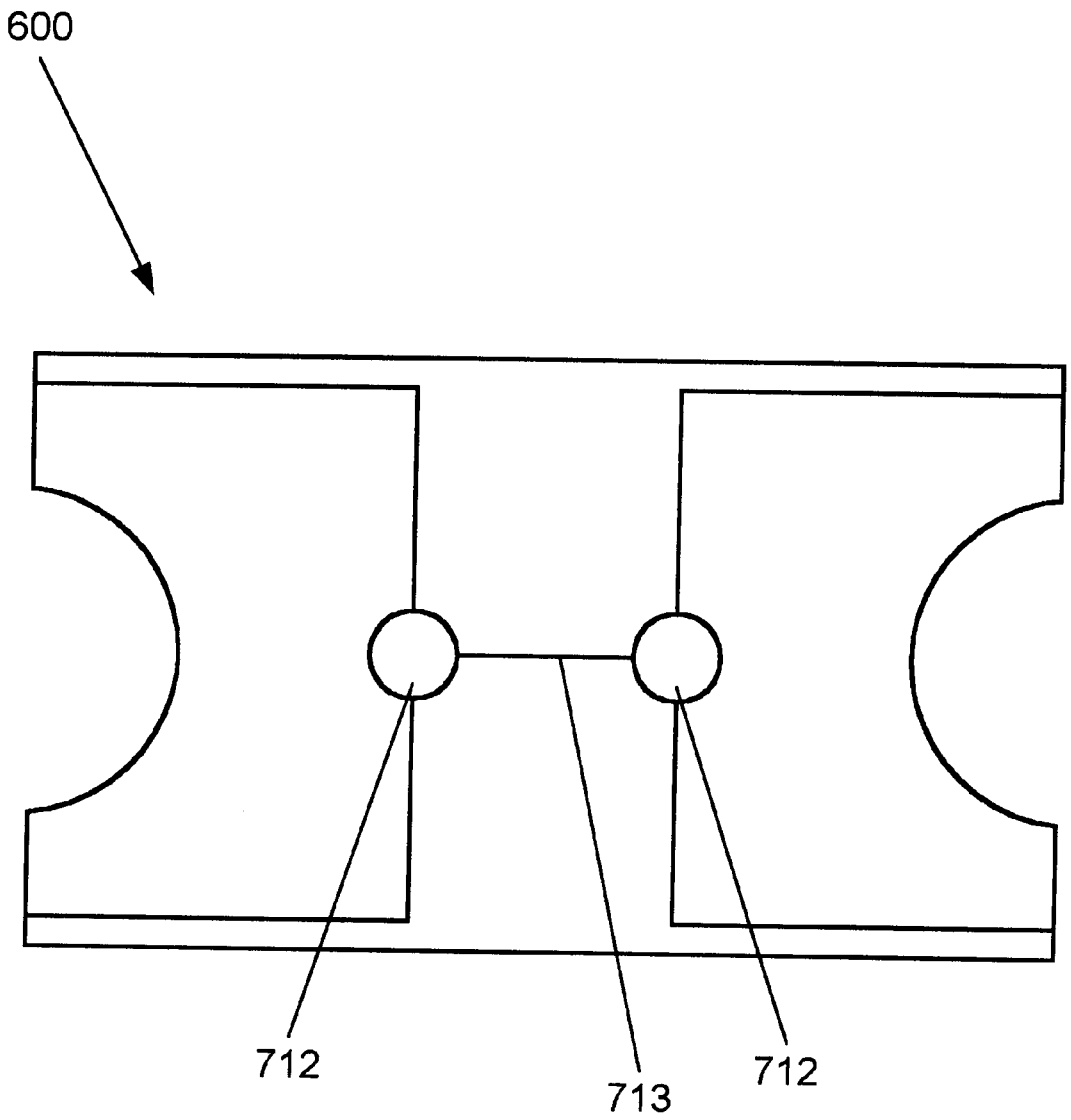
FIG. 19 is a top view of a bridgewire mounted across the ceramic substrate.
Figure 20:
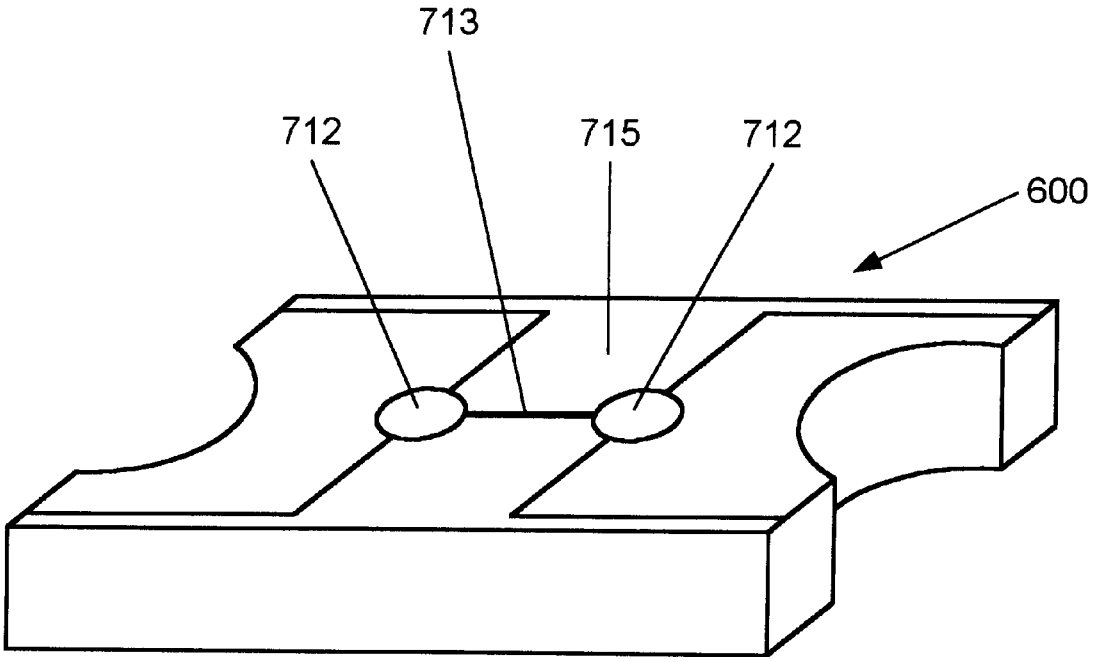
FIG. 20 is a perspective view of a bridgewire mounted across the ceramic substrate.

In still another embodiment shown in FIGS. 19–20, the present invention includes a bridgewire 713 instead of a SCB die 500 and a flat ceramic surface 715 to support the bridgewire 713 and uses the same mounting method described in connection with FIGS. 14–18. Favorable results can be obtained when the bridgewire is in the range of 0.002 inch in diameter and is of Tophet A or C material obtainable from California Fine Wire Company, in Grover City, Calif.

A number of advantages of the present invention have been confirmed in the SCB die mounting method test results described above (Table I) and in the unloaded SCB die function test described below (Table II). In addition, the SCB die were fired using a capacitive discharge firing unit as described below after unbindered and bindered $ZrKClO_4$ (CJP-5 and CJP-7) was consolidated at various pressures. As shown in column one of Table III below, the test results indicate a long and inconsistent function time, for example in the range of 500 to 1,000 microseconds. Function time is defined as the time from application of a firing energy to the SCB die to the indication of a light output. One suitable firing unit is Quantic Industries, Inc. part no. 28759.

TABLE II

UNLOADED SCB DIE FUNCTION TEST RESULTS

| Firing Voltage (Volts) | Mean Firing Capacitor ($\mu$F) | Mean Function Time ($\mu$sec) | Mean Total Energy (mJ) |
|---|---|---|---|
| 20 | 40 | 1.725 | 2.853 |
| 30 | 40 | 0.575 | 5.373 |
| 40 | 40 | 0.450 | 11.333 |
| 50 | 40 | 0.350 | 18.850 |

To evaluate the causes for the inconsistent function times, inert SCB dies were fired at various voltage levels and the function times were measured. Test results showed that function times are roughly inversely proportional to the firing voltage (see Table II). After testing, applicants concluded that the inconsistent function times of loaded units were caused by an inconsistent plasma heating stage caused by an inconsistent firing energy deposition.

In order for the SCB dies to perform consistently, applicants believe that the consistent electrical current pulse must be delivered to the SCB die so consistent energy deposition is obtained. Nevertheless, the firing energy deposition occurs over a finite time and distinct phases in the SCB die operation may be recognized. Consistent SCS die operation depends on the occurrence of distinct phases in the SCB die: the SCB die is heated through melt, vaporization, and finally into an ionized plasma phase. Therefore, if there is an inadequate delivery of firing energy caused by a damaged SCB die and/or damaged electrical connections, distinct phases in the SCB die operation may not be recognized and therefore will result in inconsistent function times.

To induce consistent phases in the SCB die operation, the consistency of the firing energy deposition was increased by preventing the structural damage of the SCB die and electrical connections during consolidation of explosive powder via improved mounting method. This resulted in faster and consistent function times: Unbindered $ZrKClO_4$ (CJP-5) was recorded at from 84 to 149 $\mu$secs and bindered $ZrKClO_4$ (CJP-7) was recorded al from 180 to 319 $\mu$secs (Table III, cols. 3 and 3). Although the difference in the magnitude of the function times between the bindered and the unbindered $ZrKClO_4$ was clearly exhibited as the result of differences of sensitivity, both groups exhibited consistent function times resulted by improved SCB die mounting method.

TABLE III

LOADED SCB DIE FUNCTION TEST RESULTS

| Consolidation Pressure | FSSM/CJP-5 50V/40 $\mu$F/ Unconfined | | FSEM/CJP-5 30V/40 $\mu$F/ Confined | | TSEM/CJP-7 30V/40 $\mu$F/ Confined | |
|---|---|---|---|---|---|---|
| | Mean F/T ($\mu$sec) | Mean Et (mJ) | Mean F/T ($\mu$sec) | Mean Et (mJ) | Mean F/T ($\mu$sec) | Mean Et (mJ) |
| 2,500 psi | 829 | 12.22 | 149 | 4.99 | 319 | 6.058 |
| 5,000 psi | 1075 | 10.88 | 106 | 5.99 | 288 | 6.165 |
| 7,500 psi | 507 | 17.23 | 84 | 6.55 | 180 | 6.375 |

Note:
FSSM Flat ceramic surface/solder mount
FSEM Flat ceramic surface/epoxy mount (i.e. less than 30 minutes curing epoxy)
TESM Trench ceramic/epoxy and solder mount (i.e. less than 30 minutes curing epoxy)
F/T That is, the function time - the time period from application of firing energy to the indication of light output
Et total energy deliver to the bridge In Table III headings, "confined" means the SCB die 500 is mounted in a trench 605; and "unconfined" means that the SCB die 500 is mounted on a flat surface of ceramic substrate 600. Based on the foregoing description, it is evident that applicants have arrived at an improved method for SCB die mounting on a header for producing an improved electroexplosive device. Further, it appears the preferred mounting method includes a ceramic substrate with a trench with adhesive epoxy at the bottom for securing the SCB die, solder between the pins and metallization patterns, as well as solder between the conducting layers and metallization pattern.

The invention now being fully described. it will be apparent to one of ordinary skill in the art that many changes and modifications can be made thereto without departing from the spirit or scope of the appended claims.

We claim:

1. A semiconductor bridge die assembly, comprising:

an insulating substrate having a top and a bottom;

a semiconductor bridge in a portion of the substrate and first and second spaced apart contact pads in a top portion of the substrate;

a first conducting layer which wraps around the substrate from the first contact pad to the bottom;

a second conducting layer which wraps around the substrate from the second contact pad to the bottom; and an explosive material contacting the semiconductor bridge.

2. The assembly of claim 1, wherein the surface area of each of the contact pads is not more than twice the top surface area of the semiconductor bridge.

3. The assembly of claim 1 or 2, further comprising:

a second substrate having a top and a bottom, wherein the top of the second substrate is adjacent to the bottom of the insulating substrate, and the top of the second substrate includes spaced apart first and second conductive areas; and a header including two conducting pins insulated from each other and extending through the header, one pin being connected to the first conductive area and the other pin being connected to second conductive area.

4. The assembly of claim 3, wherein the semiconductor bridge is connected to the first and the second conductive area.

5. The assembly of claim 4, further comprising a transistor outline (TO) package, wherein the semiconductor bridge is mounted within the transistor outline (TO) package.

6. The assembly of claim 1, wherein the first and second contact pads comprise one or more layers selected from the group consisting of palladium silicide, titanium and tungsten, and gold.

7. The assembly of claim 6, wherein the top surface area of each of the contact pads is not more than twice the top surface area of the semiconductor bridge.

8. The assembly of claim 6 or 7, further comprising:

a second substrate having a top and a bottom, wherein the top of the second substrate is adjacent to the bottom of the insulating substrate, and the top of the second substrate includes spaced apart first and second conductive areas; and a header including two conducting pins insulated from each other and extending through the header, one pin being connected to the first conductive area and the other pin being connected to second conductive area.

9. The assembly of claim 8 wherein the semiconductor bridge is connected to the first and the second conductive area.

10. The assembly of claim 9, further comprising a transistor outline (TO) package, wherein the semiconductor bridge is mounted within the transistor outline (TO) package.

11. The assembly of claim 1, wherein the insulating substrate is comprised of intrinsic silicon.

12. The assembly of claim 11, wherein the top surface area of each of the contact pads is not more than twice the top surface area of the semiconductor bridge.

13. The assembly of claim 11 or 12, further comprising:

a second substrate having a top and a bottom, wherein the top of the second substrate is adjacent to the bottom of the insulating substrate, and the top of the second substrate includes spaced apart first and second conductive areas; and a header including two conducting pins insulated from each other and extending through the header, one pin being connected to the first conductive area and the other pin being connected to second conductive area.

14. The assembly of claim 13, wherein the semiconductor bridge is connected to the first and second conductive area.

15. The assembly of claim 14 further comprising a transistor outline (TO) package, wherein the semiconductor bridge is mounted within the transistor outline (TO) package.

16. The assembly of claim 11, wherein the first and second contact pads comprise one or more layers selected from the group consisting of palladium silicide, titanium and tungsten, and gold.

17. The assembly of claim 16 wherein the top surface area of each of the contact pads is not more than twice the top surface area of the semiconductor bridge.

18. The assembly of claim 11 or 17, further comprising:

a second substrate having a top and a bottom, wherein the top of the second substrate is adjacent to the bottom of the insulating substrate, and the top of the second substrate includes spaced apart first and second conductive areas; and a header including two conducting pins insulated from each other and extending through the header, one pin being connected to the first conductive area and the other pin being connected to second conductive area.

19. The assembly of claim 18, wherein the semiconductor bridge is connected to the first and second conductive area.

20. The assembly of claim 19, further comprising a transistor outline (TO) package, wherein the semiconductor bridge is mounted within the transistor outline (TO) package.

21. A semiconductor bridge assembly, comprising:

an insulating substrate having a top and a bottom;

a semiconductor bridge in a portion of the substrate and first and second spaced apart contact pads in a top portion of the substrate;

a first conducting layer wrapping around the substrate from the first contact pad to the bottom;

a second conducting layer wrapping around the substrate from the second contact pad to the bottom;

a second substrate with spaced apart first and second conductive areas and including a trench in between the spaced apart conductive areas for receivably mounting the semiconductor bridge;

a header, supporting the second substrate, including two conducting pins insulated from each other and extending through the header, one pin being connected to the first conductive area and the other pin being connected to second conductive area;

a cover mounted to the header, wherein the cover and the header define a space; and an explosive material within the space and contacting the semiconductor bridge.

* * * * *